US009316200B2

(12) United States Patent
Woerner et al.

(10) Patent No.: US 9,316,200 B2
(45) Date of Patent: Apr. 19, 2016

(54) LASER-INDUCED SPARK IGNITION FOR AN INTERNAL COMBUSTION ENGINE

(75) Inventors: Pascal Woerner, Korntal-Muenchingen (DE); Juergen Raimann, Weil der Stadt (DE); Joerg Engelhardt, Ditzingen (DE); Martin Weinrotter, Vitoria-Gasteiz (ES)

(73) Assignee: ROBERT BOSCH GMBH, Stuttgart (DE)

( * ) Notice: Subject to any disclaimer, the term of this patent is extended or adjusted under 35 U.S.C. 154(b) by 491 days.

(21) Appl. No.: 13/700,183

(22) PCT Filed: Mar. 25, 2011

(86) PCT No.: PCT/EP2011/054603
§ 371 (c)(1), (2), (4) Date: Feb. 12, 2013

(87) PCT Pub. No.: WO2011/147606
PCT Pub. Date: Dec. 1, 2011

(65) Prior Publication Data

US 2013/0139774 A1 Jun. 6, 2013

(30) Foreign Application Priority Data

May 27, 2010 (DE) ..... 10 2010 029 382

(51) Int. Cl.
*F02P 23/04* (2006.01)

(52) U.S. Cl.
CPC ..... *F02P 23/04* (2013.01)

(58) Field of Classification Search
CPC ..... F02P 23/04; F02P 23/045; H01S 3/0627; H01S 3/09415; H01S 3/113; H01S 3/025; H01S 3/042; H01S 3/094053; H01S 3/0071; H01S 3/0941; H01S 5/183; H01S 5/423; H01S 3/0404; H01S 3/0405; H01S 3/061; H01S 3/0804; H01S 3/082; H01S 3/094057; H01S 3/094061; H01S 3/094076; H01S 3/09408; H01S 3/1024; H01S 3/1115; H01S 3/1611; H01S 3/1643; H01S 3/2383; H01S 5/02208; H01S 5/02288; H01S 5/02438
USPC ..... 123/143
See application file for complete search history.

(56) References Cited

U.S. PATENT DOCUMENTS 4,852,529 A * 8/1989 Vowles ..... F02P 23/04 123/143 B
6,053,140 A * 4/2000 Feichtinger ..... F02P 23/045 123/143 B (Continued)

FOREIGN PATENT DOCUMENTS

DE 10 2006 018973 10/2007
DE 10 2007 045180 4/2009

(Continued)

OTHER PUBLICATIONS

International Search Report for PCT/EP2011/054603, dated Aug. 18, 2011.

*Primary Examiner* — Hai Huynh
*Assistant Examiner* — John Bailey
(74) *Attorney, Agent, or Firm* — Kenyon & Kenyon LLP

(57) ABSTRACT

A laser spark plug for an internal combustion engine has at least one laser unit for guiding, shaping, and/or for producing laser radiation, a combustion chamber window, and a housing which has, at the side of the combustion chamber window situated opposite the laser unit, a screen for the passage of the laser radiation guided, shaped, and/or produced by the laser unit into a combustion chamber, the screen having a first end facing the combustion chamber and a second end facing away from the combustion chamber, the inner contour of the screen having an extremal cross-section in a region that is situated at a distance both from the first and second ends.

9 Claims, 13 Drawing Sheets

(56) References Cited

U.S. PATENT DOCUMENTS

| | | | | |
|---|---|---|---|---|
| 7,036,476 | B2 * | 5/2006 | Wintner | G02B 5/1876 123/143 B |
| 7,350,493 | B2 * | 4/2008 | Scarisbrick | F02P 23/04 123/143 B |
| 7,412,129 | B2 * | 8/2008 | Yalin | F02D 35/022 385/31 |
| 8,146,554 | B2 * | 4/2012 | Gruber | F02P 23/04 123/143 B |
| 8,265,851 | B2 * | 9/2012 | Girouard | F01D 17/02 123/429 |
| 2004/0168662 | A1 * | 9/2004 | Wintner | G02B 5/1876 123/143 B |
| 2006/0032471 | A1 * | 2/2006 | Yalin | F02P 23/04 123/143 B |
| 2006/0037572 | A1 * | 2/2006 | Yalin | F02D 35/022 123/143 B |
| 2006/0078675 | A1 * | 4/2006 | Kumar | B05B 7/22 427/248.1 |
| 2007/0064746 | A1 * | 3/2007 | Winklhofer | F02P 23/04 372/10 |
| 2008/0257294 | A1 * | 10/2008 | Vogel | F02B 23/105 123/143 B |
| 2008/0264371 | A1 * | 10/2008 | Taido | F02P 15/00 123/143 B |
| 2009/0107436 | A1 * | 4/2009 | Schultz | F02B 19/12 123/143 B |
| 2009/0120395 | A1 * | 5/2009 | Kramer | F02P 23/045 123/143 R |
| 2009/0133654 | A1 * | 5/2009 | Bihari | F02P 5/1512 123/143 B |
| 2009/0133655 | A1 * | 5/2009 | Inohara | F02P 23/04 123/143 B |
| 2009/0158952 | A1 * | 6/2009 | Gruber | F02P 23/04 102/201 |
| 2009/0159031 | A1 * | 6/2009 | Gruber | F02M 57/06 123/143 B |
| 2009/0159032 | A1 * | 6/2009 | Gruber | F02P 23/04 123/143 B |
| 2009/0159033 | A1 * | 6/2009 | Steigleman, Jr. | F02P 23/04 123/143 B |
| 2010/0031909 | A1 * | 2/2010 | Herden | F02P 17/12 123/143 B |
| 2010/0147259 | A1 * | 6/2010 | Kuhnert | F02P 23/04 123/260 |
| 2011/0180030 | A1 * | 7/2011 | Martin | F02P 23/04 123/143 B |
| 2011/0203542 | A1 * | 8/2011 | Weinrotter | F02P 23/04 123/143 B |
| 2011/0259292 | A1 * | 10/2011 | Woerner | F02P 23/04 123/143 B |
| 2012/0024250 | A1 * | 2/2012 | Weyl | F02C 7/264 123/143 B |
| 2012/0024251 | A1 * | 2/2012 | Weinrotter | F02B 23/101 123/143 B |
| 2012/0060791 | A1 * | 3/2012 | Woerner | F02B 19/12 123/260 |
| 2012/0145107 | A1 * | 6/2012 | Schwarz | F02P 23/04 123/143 B |
| 2012/0180744 | A1 * | 7/2012 | Gruber | F01P 3/16 123/169 R |
| 2013/0047946 | A1 * | 2/2013 | Hartke | F02P 23/04 123/143 B |
| 2013/0186361 | A1 * | 7/2013 | Nuebel | F02P 13/00 123/143 B |
| 2013/0186362 | A1 * | 7/2013 | Kanehara | F02P 15/08 123/143 B |
| 2013/0199483 | A1 * | 8/2013 | Herden | F02B 19/12 123/143 B |
| 2013/0255613 | A1 * | 10/2013 | Hartke | F02P 23/04 123/143 B |
| 2014/0109855 | A1 * | 4/2014 | Gruber | F02P 23/04 123/143 B |
| 2014/0238329 | A1 * | 8/2014 | Woerner | F02P 23/045 123/143 B |
| 2014/0290613 | A1 * | 10/2014 | Gruber | F01P 1/06 123/143 B |

FOREIGN PATENT DOCUMENTS

| | | | | |
|---|---|---|---|---|
| EP | 2 072 803 | | 6/2009 | |
| EP | 2072803 | A2 * | 6/2009 | F02P 13/00 |
| WO | WO 02081904 | A1 * | 10/2002 | |
| WO | WO 02095220 | A1 * | 11/2002 | |
| WO | WO 2005/066488 | | 7/2005 | |
| WO | WO 2010112279 | A1 * | 10/2010 | F02P 23/04 |
| WO | WO 2010139576 | A1 * | 12/2010 | |

* cited by examiner

LASER-INDUCED SPARK IGNITION FOR AN INTERNAL COMBUSTION ENGINE

BACKGROUND OF THE INVENTION

1. Field of the Invention

The present invention relates to a laser spark plug.

2. Description of the Related Art

For example from published international patent application document WO 2005/066488 A1, a device for igniting an internal combustion engine is known that includes an ignition laser. The ignition laser has, at its end at the combustion chamber side, a combustion chamber window that is transmissive for the laser impulses emitted by the ignition laser. At the same time, the combustion chamber window must withstand the high pressures and temperatures prevailing in the combustion chamber, and must seal the interior of the ignition laser against the combustion chamber. Here high surface temperatures and pressures, as well as contamination, for example in the form of deposits of oil ashes, particles, etc., may occur in particular at the surface of the combustion chamber window facing the combustion chamber.

In the known device, it is to be regarded as disadvantageous that particular components of exhaust gases, such as for example oil ashes or rust, damage the combustion chamber window, for example in that such components are deposited on the combustion chamber window and impair its properties, in particular its transmission for laser radiation.

BRIEF SUMMARY OF THE INVENTION

In contrast, the present invention has the advantage that the operation of the laser spark plug is made more reliable. In particular, inventive measures are taken in order to reduce deposits on the combustion chamber window. For this purpose, according to the present invention it is provided that a laser spark plug for an internal combustion engine includes at least one means for guiding, shaping, and/or for producing laser radiation, and includes a combustion chamber window and a housing, the housing having a screen at the side of the combustion chamber window opposite the means, in particular at an end of the housing at the combustion chamber side, for the passage into a combustion chamber of the laser radiation guided, shaped, and/or produced by the means. The screen influences the conditions to which the combustion chamber window is exposed, so that the formation of deposits on the combustion chamber window is reduced and the overall reliability of the laser spark plug is improved.

The means for guiding, shaping, and/or producing laser radiation can on the one hand be a solid-state laser, for example a passively Q-switched solid-state laser, for example having a monolithic design. Devices for the optical excitation of the solid-state laser, in particular semiconductor lasers, can be included in the laser spark plug. Alternatively, it is possible to situate devices for the optical excitation of the solid-state laser at a distance from the laser spark plug. In this case, the means for guiding, shaping, and/or producing laser radiation can be an optical window or an optical fiber through which radiation that acts to optically excite the solid-state laser can enter into the laser spark plug. It is also possible to situate one or more solid-state lasers, in particular Q-switched or mode-coupled solid-state lasers, at a distance from the laser spark plug. In this case, their emission can be supplied to the laser spark plug for example in an optical fiber, the laser spark plug itself having no laser-active element, but rather having only radiation-guiding and/or radiation-shaping means, in particular lenses and/or mirrors.

The housing ensures in particular that the laser spark plug is capable of being mounted on an internal combustion engine. For this purpose, known fastening means can be provided such as threading included in the housing, and/or sealing and/or seating surfaces included in the housing, which can enter into interaction with further fastening means, for example clamping jaws. In addition, the housing has in particular the task of mechanically fixing the at least one means for guiding, shaping, and/or producing laser radiation and the combustion chamber window.

The combustion chamber window is a transparent component made up of at least one solid body that is permanently resistant to heat and to radiation, for example made of glass or crystal, for example sapphire. It is in particular the rearmost component, in the direction of radiation, of the named type included in the laser spark plug, so that the surface of the combustion chamber window facing the combustion chamber communicates with the combustion chamber.

In order to largely reduce contamination and/or damage to the side of the combustion chamber window exposed to the combustion chamber, due to conditions prevailing in the combustion chamber (high temperature, high pressure, high flow speed) and media (particles, oil ashes, etc.), according to the present invention it is provided that the housing has a screen on its side of the combustion chamber window situated opposite the means for guiding, shaping, and/or producing laser radiation, i.e. in particular at the side of the combustion chamber window facing the combustion chamber. In this way, the combustion chamber window is situated in particular between the means for guiding, shaping, and/or for producing laser radiation and the screen. Preferably, the screen forms an end segment of the housing, at the combustion chamber side. It is possible in particular to fashion the screen in one piece with the housing of the laser spark plug, and/or to fashion it from the same material as the housing. Alternatively, the screen is fashioned as a separate component and is fastened to a further part of the housing, for example by welding or by a screw connection. Optionally, further assemblies included in the laser spark plug, for example rinsed and/or unrinsed prechambers, are situated at the combustion chamber side of the screen.

The screen is in particular a structure having a passageway, in particular exactly one passageway. The side of the combustion chamber window facing the combustion chamber communicates with the combustion chamber and/or with a prechamber of the laser spark plug situated before the screen, in particular exclusively, through the one passageway of the screen. The passageway is limited radially, relative to the direction of radiation, by the inner contour of the screen. Moreover, the passageway is provided for the passage of the laser radiation, guided, shaped, and/or produced by the means, into a combustion chamber of an internal combustion engine, into a prechamber of the combustion chamber, and/or into a prechamber, situated before the screen, of the laser spark plug.

The basic idea of the present invention is that through the provision of a screen, or through a suitable realization of such a screen, a protection of the combustion chamber window is possible, in particular a protection of the combustion chamber window from conditions prevailing in a combustion chamber, in particular high temperatures, high flow speeds, and media such as oil ashes, etc.

Through the screen provided according to the present invention, on the one hand the quantity of contamination deposited on the combustion chamber window in the form of particles, oil ashes, etc., is reduced. On the other hand, the impulse with which for example the particles impinge on the surface of the combustion chamber window is reduced. Both effects bring it about that deposits on the combustion chamber window are significantly reduced, and that the few deposits adhere less strongly to the combustion chamber window. Consequently, the laser ignition device according to the present invention is more reliable. A further effect of the screen is that the temperature of the combustion chamber window is lowered. The lowered temperature prevents a chemical reaction of the deposits, or a chemical reaction of the combustion chamber window with the deposits, such as a burning in of the deposits and thus a lasting damage to the combustion chamber window. Lasting deposits thus adhere less strongly to the combustion chamber window, and can easily be removed therefrom. A reduction of the pressure on the combustion chamber window, or of the pressure change rates taking place there, can also be brought about by a screen according to the present invention, and increases in reliability can also result from this.

In further advantageous embodiments of the present invention, it is provided that the length of the screen is selected in a targeted fashion. Here, the length of the screen is to be understood in particular as the length of the passage through the screen in the direction of radiation. Alternatively, longitudinal axis of the laser spark plug, or a direction perpendicular to the surface of the combustion chamber window facing the combustion chamber, may be taken as a basis. The length of the passage is further measured between the screen opening facing the combustion chamber (also: exit opening) and the screen opening facing away from the combustion chamber (also: entry opening). In the case of screens or passageways having irregularly shaped openings, the position thereof is in particular to be tailored to whether a lateral shielding of the segment regarded as a passageway is predominantly present. The avoiding of deposits on the combustion chamber window, in particular through flow deflection and through lowering of the temperature of the combustion chamber window, takes place in screens whose length is 4 mm or more. Increasingly particularly good results are achieved with screens whose minimum length is 6 mm, 8 mm, 10 mm, or 12 mm. Possible upper limits for the length of the screen are 25 mm, 20 mm, or 15 mm. Still longer screens could excessively increase the length, and thus the space required for the installation of a laser spark plug.

In further advantageous embodiments of the present invention, in addition or alternatively to the targeted selection of the length of the screen, in a laser spark plug for an internal combustion engine having at least one means for guiding, shaping, and/or for producing laser radiation, further including a combustion chamber window and a housing, the housing having, at the side of the combustion chamber window situated opposite the means, in particular at an end of the housing at the combustion chamber side, a screen for the passage of the laser radiation guided, shaped, and/or produced by the means into a combustion chamber, it is provided to select the screen, in particular a material of the screen, in a targeted manner in such a way that it has a high thermal conductivity.

Preferably, the material of the screen should also have a high resistance to wear, in particular resistance to heat, as can be achieved for example using high-alloy steels.

The material of the overall screen can be made uniform with the overall housing, and can have a high degree of thermal conductivity. However, it is also possible to form only the overall screen from a material having a high thermal conductivity, while further components of the housing have a different thermal conductivity, in particular a lower one. It is also possible to form only parts of the screen, for example parts that are predominant with regard to mass and/or volume, and/or parts situated in the interior of the screen, fashioned as it were as "cores," from a material having a high thermal conductivity, while further parts of the screen have a different thermal conductivity, in particular a lower one. With such a configuration, it is advantageously possible to achieve the setting of the desired thermal conduction with simultaneously high resistance to wear.

The avoidance of deposits on the combustion chamber window, in particular through the lowering of the temperature of the combustion chamber window, occurs already if the screen includes a material having a thermal conductivity of 60 W(m*K) or more, and in particular is made of such a material entirely or in portions. Increasingly good results are achieved with screens that have a material having a thermal conductivity of 80 W(m*K) or more or 120 W(m*K) or more, and are in particular made of such a material. Possibilities here include in particular brass and nickel and copper and alloys of brass and nickel, as well as copper alloys, and in particular copper for interior parts of the screen, fashioned as it were as "cores."

In a laser spark plug for an internal combustion engine including at least one means for guiding, shaping, and/or for producing laser radiation, further including a combustion chamber window and a housing, the housing having, at the side of the combustion chamber window situated opposite the means, in particular at an end of the housing at the combustion chamber side, a screen for the passage of the laser radiation guided, shaped, and/or produced by the means into a combustion chamber, a further measure for lowering the temperature of the combustion chamber is to provide at least one cooling duct in the interior of the screen. The cooling duct is in particular provided so that a cooling medium, for example a cooling liquid, can flow through it. The provision of a multiplicity of cooling ducts and/or of a cooling duct diameter of 1 $mm^2$ or more and/or 5 $mm^2$ or less is preferred. Such a cooling duct is already inherently suitable for lowering the temperature of the combustion chamber window. In interaction with a screen that has a material having high thermal conductivity, the heat from the screen can be supplied particularly well to the cooling duct and thus conducted away from the screen.

Both the targeted selection of the length of the screen and the targeted selection of material and/or the provision of cooling ducts are suitable, in themselves but in particular also in interaction, for lowering the temperature of the combustion chamber window; in particular, combinations of an indicated feature relating to the length of the screen with an indicated feature relating to the thermal conduction of the screen are advantageous with regard to avoiding deposits on the combustion chamber window and thus with regard to the reliability of the laser spark plug. The lowering of the temperature of sealing points situated in the area of the combustion chamber window also improves the reliability of the laser spark plug.

In further advantageous embodiments of the present invention, in addition or alternatively to the targeted selection of the length of the screen, and in addition or alternatively to the provision of a high degree of thermal conductivity of the screen, it is provided that in a laser spark plug for an internal combustion engine including at least one means for guiding, shaping, and/or for producing laser radiation, further including a combustion chamber window and a housing, the housing having, at the side of the combustion chamber window situated opposite the means, in particular at an end of the housing at the combustion chamber side, a screen for the passage of the laser radiation guided, shaped, and/or produced by the means into a combustion chamber, a gap that communicates with the interior of the screen is positioned before the combustion chamber window at the combustion chamber side, the height of said gap being purposefully selected to be small.

A gap is here to be understood in particular as a spatial region that is limited axially at both sides, in particular by the combustion chamber window and by the screen at a respective side, and is limited radially externally, in particular by the housing, and communicates with the interior of the screen via its radial inner side. In a particular embodiment, the gap is thus fashioned between the screen and the combustion chamber window. The height of the gap is to be understood in particular as the spacing of the surfaces that axially limit the gap. In the case of irregular geometries, this is to be tailored to whether an axial limiting of the gap is predominantly present.

This embodiment of the present invention is based on the one hand on the recognition that the temperature of a hot gas penetrating into the gap fashioned according to the present invention, in particular of a burning gas, strongly decreases. As a consequence, a so-called quenching takes place, bringing with it an extinguishing of the burning gas and a formation of rust inside the gap. On the other hand, this embodiment of the present invention is also based on the recognition that the rust formed in this way can also be deposited on the side of the combustion chamber window facing the combustion chamber, but can be reliably ablated by laser radiation having intensities such as those that standardly occur in the region of the combustion chamber window, so that overall the rust formation occurring in the gap results in only a moderate impairment of the transparency of the combustion chamber window.

Surprisingly, it has turned out that the continuous deposition and ablation of rust on the side of the combustion chamber window facing the combustion chamber can have the effect that the contamination of the side of the combustion chamber window facing the combustion chamber by other materials, in particular by further combustion products such as oil ashes, can be prevented or significantly reduced. This fact is particularly important because such materials, in particular oil ashes, cannot be reliably ablated, or can be reliably ablated only partially or with increased expense, by laser radiation having intensities such as those that standardly occur in the area of the combustion chamber window.

The avoidance that results overall of deposits on the combustion chamber window occurs for gap heights that are at most 1 mm, at most 0.5 mm, at most 0.3 mm, or at most 0.1 mm. Possible lower limits for the height of the gap are 0.05 mm and 0.08 mm. Sufficient rust cannot form in gaps that are too flat. Moreover, it is advantageous to situate the gap immediately before the combustion chamber window and/or to select the base surface of the gap to be annular or sickle-shaped.

The surface content of the base surface of the gap (called "gap cross-section" hereinafter) is preferably selected sufficiently large that the quantity of penetrating gas is sufficient for an adequate rust formation. Here it is increasingly advantageous if a region in the interior of the screen, positioned before the gap at the combustion chamber side, has an entry cross-section of the screen and the gap cross-section is at least 10% of the entry cross-section, at least 30% of the entry cross-section, or at least 50% of the entry cross-section, or is at least twice as large as the entry cross-section, or at least four times as large as the entry cross-section. Possible upper limits for gap cross-sections are those that are 25 times as large as the entry cross-section, in particular 10 times as large as the entry cross-section, because otherwise the laser spark plug would be excessively large.

The targeted selection of the length of the screen, the targeted selection of material, and/or the provision of cooling ducts, as well as the provision according to the present invention of a gap of the type described above, are in themselves alone already suitable to bring about the lowering of the temperature in a volume positioned before the combustion chamber window. In particular, however, an efficient cooling in this volume, and thus the bringing about of quenching effects and rust formation, takes place through an interaction of the gap with a screen that is long and/or has good thermal conductivity, in which the volume enclosed by the gap is cooled particularly effectively through the interaction with the combustion chamber window, which has a relatively low temperature.

The above-described effect of rust formation, deposition, and ablation is advantageous in particular given the use of laser spark plugs in internal combustion engines whose lubrication makes use of oils having additives, in particular oils having a higher degree of additives, because in particular when such oils are combusted there result oil ashes that are removable only with difficulty by other means. On the other hand, the idea should also be kept in mind of optimizing laser spark plugs for use in internal combustion engines whose lubrication makes use of oils not having additives, i.e. ash-free oils, by completely or partially doing without a formation of rust which would then not be necessary. In this sense, in a laser spark plug for an internal combustion engine including at least one means for guiding, shaping, and/or for producing laser radiation, further including a combustion chamber window and a housing, the housing having at the side of the combustion chamber window situated opposite the means, in particular at an end of the housing at the combustion chamber side, a screen for the passage of the laser radiation guided, shaped, and/or produced by the means into a combustion chamber, a gap that communicates with the interior of the screen is positioned before the combustion chamber window at the combustion chamber side, it would be appropriate to select the height of the gap in a targeted manner in such a way that rust formation is completely or at least largely avoided. For this purpose, it is advantageous to select the height of the gap not smaller than 0.3 mm, in particular not smaller than 1 mm. Rust formation can be avoided particularly reliably if the gap is still larger, for example at least 2 mm or at least 3 mm. The provision of a gap cross-section that is small in comparison to the entry cross-section of the screen is also favorable; in particular it is advantageous that the gap cross-section be at most 100%, in particular at most 40%, preferably at most 20%, of the entry cross-section of the screen.

In further advantageous embodiments of the present invention, in addition or alternatively to the targeted selection of the length of the screen, and in addition or alternatively to the provision of a high degree of thermal conductivity of the screen, and in addition or alternatively to the provision of a gap that is situated before the combustion chamber window at the combustion chamber side and that communicates with the interior of the screen and whose height is chosen to be small in a targeted manner, it is provided that in a laser spark plug for an internal combustion engine including at least one means for guiding, shaping, and/or for producing laser radiation, further including a combustion chamber window and a housing, the housing having at the side of the combustion chamber window situated opposite the means, in particular at an end of the housing at the combustion chamber side, a screen for the passage of the laser radiation guided, shaped, and/or produced by the means into a combustion chamber, the screen has at its side facing away from the combustion chamber window a small opening cross-section (also: "exit cross-section").

The exit cross-section of the screen is in particular the open cross-section, at the combustion chamber side, of the passageway of the screen. In the case of passageways having irregularly shaped exit openings, the exit cross-section is in particular to be tailored to whether a lateral shielding of the segment regarded as the passageway is predominantly present.

The smallness of the exit cross-section of the screen results in the advantageous effect that the combustion chamber window is shielded from the conditions prevailing in the combustion chamber, in particular from high temperature, from rapid changes in pressure, from high flow speeds, and/or from particles of oil ashes, rust, and the like. In this way, deposits on the combustion chamber window can be avoided, and the reliability of the laser spark plug can be increased. This effect occurs when the exit cross-section is 78 $mm^2$ or less, in particular 19 $mm^2$ or less. Increasingly particularly good results are achieved with exit cross-sections that are 7 $mm^2$ or less, in particular 2 $mm^2$ or less. Possible lower limits are 0.05 $mm^2$, 0.4 $mm^2$, and 1 $mm^2$. In the case of still smaller exit diameters, the passage of the laser radiation through the screen is in some circumstances no longer sufficiently securely ensured.

The targeted selection of the length of the screen, the targeted selection of material, and/or the provision of cooling ducts are each, in themselves alone or in combination with each other, already suitable to lower the temperature of the combustion chamber window, so that a "burning in" of contamination on the combustion chamber window is reduced, thus increasing the reliability of the laser spark plug. Through the provision of a gap positioned before the combustion chamber window at the combustion chamber side, a similar effect can be achieved in the manner described above. If these measures are combined with the provision of a small exit cross-section of the screen, overall the effect occurs that on the one hand fewer particles reach the combustion chamber window, while on the other hand, however, the combustion chamber window is also more resistant to contamination by these remaining particles. The reliability of the laser spark plug can be significantly increased in this manner.

Advantageous specific embodiments provide, in addition or alternatively to the targeted selection of the length of the screen and in addition or alternatively to the provision of a high degree of thermal conductivity of the screen, and in addition or alternatively to the provision of a gap that is positioned before the combustion chamber window at the combustion chamber side and that communicates with the interior of the screen and whose height is deliberately selected to be small, and in addition or alternatively to the provision of a small exit cross-section of the screen, that a laser spark plug for an internal combustion engine includes at least one means for guiding, shaping, and/or producing laser radiation, and includes a combustion chamber window and a housing, the housing having at the side of the combustion chamber window situated opposite the means, in particular at an end of the housing at the combustion chamber side, a screen, in particular a cylindrical screen, for the passage of the laser radiation guided, shaped, and/or produced by the means into a combustion chamber, the length of the screen being L and the exit cross-section of the screen being $Q_{BA}$, such that $1<L/(4Q_{BA}/\Pi)^{1/2}\leq 10$.

Through this targeted matching of the length of the screen to the opening cross-section, or opening diameter, of the screen, it is always ensured that excessive stress on the combustion chamber window due to the action of damaging conditions such as those prevailing in combustion chambers of internal combustion engines is avoided. Here it is essential that the overall effect of the length and screen and of the opening cross-section of the screen are taken into account in the context of the condition $1<L/(4Q_{BA}/\Pi)^{1/2}\leq 10$. This is based on the recognition that even relatively short screens can have the advantages according to the present invention, provided that the opening cross-section of these screens is small in the defined dimension. On the other hand, screens having a relatively large opening cross-section may still also have a sufficient shielding effect, provided that the screen has a large length. The indicated technical effect occurs in particular when $2\leq L/(4Q_{BA}/\Pi)^{1/2}$ and/or $L/(4Q_{BA}/\Pi)^{1/2}\leq 7$, in particular $L/(4Q_{BA}/\Pi)^{1/2}\leq 6$. In the special case of a round exit cross-section of the screen, the quantity $(4Q_{BA}/\Pi)^{1/2}$ represents the exit diameter of the screen.

In advantageous embodiments of the present invention, in addition or alternatively to the targeted selection of the length of the screen, and in addition or alternatively to the provision of a high degree of thermal conductivity of the screen, and in addition or alternatively to the provision of a gap that is positioned before the combustion chamber window at the combustion chamber side and that communicates with the interior of the screen and whose height is selected to be small in a targeted manner, and in addition or alternatively to the provision of a small exit cross-section of the screen, it is provided, in a laser spark plug for an internal combustion engine including at least one means for guiding, shaping, and/or for producing laser radiation, further including a combustion chamber window and a housing, the housing having at the side of the combustion chamber window situated opposite the means, in particular at an end of the housing at the combustion chamber side, a screen for the passage of the laser radiation guided, shaped, and/or produced by the means into a combustion chamber, that in a region situated at a distance both from the end of the screen facing the combustion chamber and from the end of the screen facing away from the combustion chamber, the inner contour of the screen has at least one edge, in particular a multiplicity of edges.

Here an edge of the inner contour of the screen is to be understood in particular as a geometrical object, in particular a line, at which different flat regions of the inner contour of the screen meet one another at an angle differing from zero. A region of the inner contour of the screen situated at a distance both from the end of the screen facing the combustion chamber and from the end of the screen facing away from the combustion chamber is to be understood as a centric region of the inner contour of the screen, in particular a region that is centric with respect to the longitudinal extension of the screen. With respect to the longitudinal extension of the screen, a region is centric in particular when it is situated between a front fifth and a rear fifth of the screen, in particular between a front quarter and a rear quarter of the screen, or is situated in a central third of the screen. An inner contour having an edge in a region is to be understood such that at least parts of the edge are situated in this region, it also being possible that the edge is also situated in, but additionally also outside, this region. As an advantageous special case, it can always also be provided that the edge is situated completely in the region.

The technical effect of an edge of the described type is that it represents a starting point for a disturbance of the flowing of gases into the screen, or of the flow in the screen. In particular, starting from the edge there can occur a turbulence of the gas flowing into the screen or of the gas flowing in the screen. As a result of the disturbance, in particular as a result of the turbulence, the interaction of the gas flowing into the screen with the inner contour of the screen is increased, and as a result of this increased interaction the tendency of particles contained in the gas to deposit inside the screen and specifically on the edges, and not to advance up to the combustion chamber window, is also increased. In this way, the edge is given something like the function of a particle trap. This results in a reduction of deposits on the combustion chamber window and in an increased reliability of the laser spark plug.

Although the described effect is achieved already through the provision of a single edge of the type described, particularly advantageous developments provide a multiplicity of such edges. A multiplicity of edges is two or more edges, in particular more than two edges. The disposition of an edge or of a multiplicity of edges is particularly effective if they are situated opposite the combustion chamber window in uncovered fashion at least along parts of the edge and/or of the combustion chamber window, i.e. without parts of the screen being situated between the parts of the edge and the parts of the combustion chamber window. In this case, the edge is in particular suited to insert a disturbance or a turbulence into those parts of the flow penetrating into the screen, or of the flow in the screen, that are predominantly directed onto the combustion chamber window.

A particularly advantageous situation of the edge, or of the multiplicity of edges, takes place in such a way that the situation of the edge, or of the multiplicity of edges, causes the formation of steps, and/or that the inner contour of the screen tapers in a stepped fashion, at least in some regions, in the direction of the end of the screen facing the combustion chamber. Here, in particular at least two, in particular at least three, preferably at least four steps can be provided. In addition, at least one additional step, in particular a multiplicity of additional steps, can be provided by which the screen tapers in the direction of its end facing the combustion chamber. A step of the inner contour is here understood in particular as a configuration of at least three partial surfaces of the inner contour, one of the partial surfaces being situated between the two other partial surfaces in the longitudinal direction of the inner contour, and the radial inclination of the one partial surface being extremal relative to the radial inclinations of all three partial surfaces. The partial surfaces can in particular have an annular shape, but other geometries are also possible in principle.

In a variant that is advantageous from the point of view of manufacturing technology, the steps are fashioned at almost a right angle (88°-92°), in particular at a right angle, i.e. in particular the two partial surfaces run parallel to a longitudinal axis of the laser spark plug, while the one partial surface is oriented perpendicular thereto. In particular a multiplicity of such steps, for example more than three or more than seven, can be provided. Steps made up of surfaces that always or partly meet one another at obtuse angles or always or partly meet one another at acute angles, but here however preferably not at angles more acute than 25°, are conceivable and are also advantageous, each in different ways. Combinations in one screen of steps of the type named are also possible in principle.

Both the provision of a small exit cross-section of the screen and the provision of at least one edge in a region that is situated at a distance both from the end of the screen facing the combustion chamber and from the end of the screen facing away from the combustion chamber each, in themselves, enable the number of particles impinging on the combustion chamber window to be reduced. If the two measures are combined with one another, there results the synergetic effect that the flow into the screen, which is spatially concentrated by the small exit cross-section of the screen, can be disturbed by suitable edges in a particularly targeted manner, and in particular can be made turbulent. Here, exit cross-sections of 78 $mm^2$ or less, in particular 19 $mm^2$ or less, preferably 7 $mm^2$ or less, particularly preferably 2 $mm^2$ or less, are advantageous, it being possible to advantageously combine this exit diameter in each case with a stepped inner contour of the screen, in particular with a stepped inner contour of the screen having a multiplicity of steps, in particular right-angled steps, in particular steps at which the cross-sectional surface of the screen increases in each case in the direction from the end of the inner contour of the screen facing the combustion chamber to the end of the inner contour of the screen facing away from the combustion chamber by at least 10%, in particular by at least 35%.

The targeted selection of the length of the screen, the targeted selection of material, and/or the provision of cooling ducts are each already suitable, by themselves or in combination with one another, to lower the temperature of the combustion chamber window, so that a "burning in" of particles on the combustion chamber window is reduced, deposits are reduced, and the reliability of the laser spark plug is thus increased. A similar effect can be achieved through the provision of a gap situated before the combustion chamber window at the combustion chamber side. If these measures are combined with the provision of at least one edge in a region that is situated at a distance both from the end of the screen facing the combustion chamber and from the end of the screen facing away from the combustion chamber, overall the effect occurs that on the one hand fewer particles reach the combustion chamber window, while on the other hand the combustion chamber window is also more resistant to contamination by these few particles. In this way, the reliability of the laser spark plug can be increased significantly.

According to the present invention, in addition or alternatively to the targeted selection of the length of the screen and in addition or alternatively to the provision of a high degree of thermal conductivity of the screen and in addition or alternatively to the provision of a gap that is situated before the combustion chamber window at the combustion chamber side and that communicates with the interior of the screen and whose height is selected to be small in a targeted manner, and in addition or alternatively to the provision of a small exit cross-section of the screen and in addition or alternatively to the provision of an edge of the type described, it is provided, in a laser spark plug for an internal combustion engine including at least one means for guiding, shaping, and/or for producing laser radiation, further including a combustion chamber window and a housing, the housing having at the side of the combustion chamber window situated opposite the means, in particular at an end of the housing at the combustion chamber side, a screen for the passage of the laser radiation guided, shaped, and/or produced by the means into a combustion chamber, the screen having an end facing the combustion chamber and an end facing away from the combustion chamber, that the inner contour of the screen has an extremal cross-section in a region that is situated at a distance both from the end of the screen facing the combustion chamber and from the end of the screen facing away from the combustion chamber.

An extremal cross-section of the inner contour of a screen is in particular to be understood as a cross-section that, with respect to its surface content and with respect to the longitudinal direction of the laser spark plug, represents a local maximum, i.e. in particular becomes smaller in both longitudinal direction, or represents a local minimum, i.e. in particular increases in both longitudinal directions. The extremal cross-section of the screen in a region that is situated at a distance both from the end of the screen facing the combustion chamber and from the end of the screen facing away from the combustion chamber can be expressed in particular in that there is a cross-section of the screen that is greater than the entry cross-section of the screen and greater than the exit cross-section of the screen, or that there is a cross-section of the screen that is smaller than the entry cross-section of the screen and smaller than the exit cross-section of the screen. The extremal cross-section is in particular a cross-section that is situated in a plane that is parallel to a plane in which the exit cross-section of the screen lies, and/or that is situated in a plane that is parallel to a plane in which the entry cross-section of the screen lies, and/or that is parallel to a plane in which the surface of the combustion chamber window facing the combustion chamber lies, and/or that is oriented perpendicular to a longitudinal axis of the laser spark plug.

The technical effect of the measure that the inner contour of the screen has an extremal cross-section in a region that is situated at a distance both from the end of the screen facing the combustion chamber and from the end of the screen facing away from the combustion chamber is that the region of the extremal cross-section is a starting point for a disturbance of the flowing of gases into the screen, or for a disturbance of the flow in the screen. In particular, starting from the region of the extremal cross-section, there can occur turbulence of the gas flowing into the screen or of the flow in the screen. As a result of the disturbance, in particular as a result of the turbulence, the interaction of the gas flowing into the screen with the inner contour of the screen is increased, and as a result of this increased interaction the tendency of the particles contained in the exhaust gas to deposit inside the screen and not to advance to the combustion chamber window is also increased. In this way, the region of the extremal cross-section is given, as it were, the effect of a particle trap.

Although the described effect results already through the provision of a region that is situated at a distance both from the end of the screen facing the combustion chamber and from the end of the screen facing away from the combustion chamber and that has an extremal cross-section, developments provide that the screen has an entry cross-section at its end facing the combustion chamber and has an exit cross-section at its end facing the combustion chamber, and that the extremal cross-section is either at least 10%, in particular at least 20%, preferably at least 30%, smaller than the entry cross-section and is at least 10%, in particular at least 20%, preferably at least 30%, smaller than the exit cross-section, or is at least 10%, in particular at least 20%, preferably at least 30%, larger than the entry cross-section and is at least 10%, in particular at least 20%, preferably at least 30%, larger than the exit cross-section. An advantageous shape of the inner contour of the screen provides that the inner contour of the screen has two segments each having a frustum shape, in particular each having the shape of a right circular frustum, these two segments preferably being immediately adjacent, i.e. adjoining one another with each of their larger or, respectively, smaller end face, thus forming as it were a double frustum. Thus, at the point at which the frustums abut one another an edge is formed that runs either along a constriction or along a bulge of the inner contour of the screen.

In addition to rotationally symmetrical inner contours of the screen, which provide in particular circumferential geometrical features such as constrictions and/or bulges and/or a recess, in principle it is possible and advantageous to deviate from a rotationally symmetrical shape of the inner contour of the screen in a laser spark plug for an internal combustion engine including at least one means for guiding, shaping, and/or for producing laser radiation, further including a combustion chamber window and a housing, the housing having at the side of the combustion chamber window situated opposite the means, in particular at an end of the housing at the combustion chamber side, a screen for the passage of the laser radiation guided, shaped, and/or produced by the means into a combustion chamber. Such asymmetries have the effect that there occurs an increased interaction of the exhaust gas flowing into the screen with the inner contour of the screen, and as a result of this increased interaction the tendency of particles contained in the exhaust gas to deposit inside the screen and not to advance to the combustion chamber window is also increased. In this way the deposits on the combustion chamber window are reduced, and the reliability of the laser spark plug is increased. Special inner contours having a shape that is not rotationally symmetrical have at least one recess, in particular a multiplicity of recesses, situated in particular at a distance both from the end of the screen facing the combustion chamber and from the end of the screen facing away from the combustion chamber. [A] bulge, in particular a multiplicity of bulges, situated in particular at a distance both from the end of the screen facing the combustion chamber and from the end of the screen facing away from the combustion chamber are also advantageous, because the recess and/or the bulge is a starting point for a disturbance of the flow of exhaust gases into the screen. In particular, starting from the recess and/or the bulge there can occur a turbulence of the gas flowing into the screen. Particularly advantageously, the bulge and/or the recess is situated in a region of the screen that is situated at a distance both from the end of the screen facing the combustion chamber and from the end of the screen facing away from the combustion chamber, and that has an extremal cross-section. In principle, it is also conceivable to provide other inner contours of the screen, in particular inner contours that are optimized with regard to a flow, for example not having sharp edges but rather being rounded and/or fashioned completely or in segments as a de Laval nozzle.

Unless explicitly otherwise indicated, the provision according to the present invention of an extremal cross-section in the described manner, and the developments of the present invention related thereto, are possible, in particular optionally, for all specific embodiments and examples of the present invention, including where not explicitly noted.

In a region of the inner contour of the screen that is situated at a distance both from the end of the screen facing the combustion chamber and from the end of the screen facing away from the combustion chamber, both the provision of one or more edges and the provision of extremal cross-sections and/or of recesses or bulges as described above already each in themselves have the effect that a disturbance of the flow of gases into the screen is present, and in particular that there occurs a turbulence of the gas flowing into the screen. This technical effect occurs to an increased degree in a screen having a plurality of the named features.

The targeted selection of the length of the screen, the targeted selection of material, and/or the provision of cooling ducts are each already suitable, alone or in combination with one another, to lower the temperature of the combustion chamber window, so that deposits on the combustion chamber window are reduced and the reliability of the laser spark plug is thus increased. Through the provision of a gap of the type described above positioned before the combustion chamber window at the combustion chamber side, a similar effect can be achieved as described above, alone and in particular in combinations. If these measures are combined with the provision of an extremal cross-section in a region that is situated at a distance both from the end of the screen facing the combustion chamber and from the end of the screen facing away from the combustion chamber, overall the effect occurs that fewer particles reach the combustion chamber window, while on the other hand however the combustion chamber window is also more resistant to contamination by these remaining particles. In this way, the useful life of the laser spark plug can be significantly increased.

In further advantageous embodiments of the present invention, it is provided that in addition or alternatively to the targeted selection of the length of the screen, and in addition or alternatively to the provision of a high degree of thermal conductivity of the screen, and in addition or alternatively to the provision of a gap that is positioned before the combustion chamber window at the combustion chamber side and that communicates with the interior of the screen and whose height is selected to be small in a targeted manner, and in addition or alternatively to the provision of a small exit cross-section of the screen, and in addition or alternatively to the provision of an edge and/or of an extremal cross-section of the type described in a laser spark plug for an internal combustion engine including at least one means for guiding, shaping, and/or for producing laser radiation, further including a combustion chamber window and a housing, the housing having at the side of the combustion chamber window situated opposite the means, in particular at an end of the housing at the combustion chamber side, a screen for the passage of the laser radiation guided, shaped, and/or produced by the means into a combustion chamber, the laser spark plug has at least one focusing means for defining a beam shape of the laser radiation passing through the screen, and the spacing between the screen and the laser radiation does not exceed a maximum distance at least along predominant parts of the inner contour of the screen.

The at least one focusing means can be a focusing optics, in particular a lens or a plurality of lenses, and/or one or more mirrors, in particular one or more mirrors each having a curved surface. The construction of the combustion chamber window and/or the construction of the means for guiding, shaping, and/or producing laser radiation as a focusing element is additionally or alternatively possible. Through the provision of the at least one focusing means, a beam shape of the laser radiation passing through the screen is fundamentally determined. In laser spark plugs in which the beam shape of the laser radiation passing through the screen is a function of further operating parameters of the laser spark plug, e.g. of a current or a temperature, the beam shape defined by the focusing means is to be understood as the beam shape that is provided by the laser spark plug when the operating parameter assumes a value that is provided for the operation of the laser spark plug. The beam shape of the laser radiation, in particular beam position, beam dimensions, and distances between beam and screen, are to be understood according to and/or against the background of the DIN EN ISO 11145 standard.

The provision that the spacing between the screen and the laser radiation is not to exceed a maximum distance at least along predominant parts of the inner contour of the screen is based on the one hand on the recognition that in order to achieve an effect that shields the combustion chamber window, and to reduce deposits on the combustion chamber window along predominant parts of the inner contour of the screen, in particular along the entire inner contour of the screen, it is conducive if the passageway of the screen is made as narrow as possible. On the other hand, opposed to this requirement is the fact that a portion that is as large as possible of the laser radiation guided, shaped, and/or produced by the means for guiding, shaping, and/or producing laser radiation is to pass through the screen, i.e., the screen must not be too narrow, in particular because manufacturing tolerances must also be taken into account.

A good compromise between these two requirements is already reached if along predominant parts of the inner contour of the screen a spacing between screen and laser radiation is indeed present but does not exceed a maximum spacing of 4 mm. Still better compromises provide that the maximum spacing along predominant parts of the inner contour of the screen is 2 mm, in particular 1 mm, preferably 0.55 mm, and/or that said spacing does not fall below a minimum spacing along the predominant parts of the inner contour of the screen, this minimum spacing advantageously being 0.1 mm, 0.25 mm, or 0.45 mm. The predominant parts of the inner contour of the screen can include 70% of the surface of the inner contour or more, 90% of the surface of the inner contour or more, or even the entire inner contour.

Instead of through geometric measures related to the screen and/or to the laser radiation, the finding of a good compromise between the named requirements can alternatively also be expressed through the portion of the laser radiation that passes through the screen. Thus, it is advantageous if this portion is between 50% and 100%, in particular between 70% and 95%, preferably between 85% and 93%, the remaining portion being in particular absorbed by the screen and/or diffusely scattered. The remaining portion is in particular no longer available for a focusing of the laser beam.

The provision of minimum and/or maximum spacings in the described manner, as well as further above-described measures, in particular the provision of a small exit cross-section of the screen, as well as the provision of the described relationships between the exit cross-section and the length of the screen, and/or the adaptation of the inner contour of the screen to the laser beam, can in each case alone already achieve a good shielding of the combustion chamber window from conditions prevailing in the combustion chamber. The shielding effect can be further significantly increased through the interaction of these measures. Overall, in this way deposits on the combustion chamber window can be reduced in a particularly effective manner, and the reliability of the laser spark plug can be significantly increased.

In addition, the provision of minimum and/or maximum spacings in the described manner enters into mutual amplification of effect with the further measures, described above or in the following, that bring about a lowering of the combustion chamber window temperature and/or a reduction of the exposure of the combustion chamber window to particles, these measures including in particular the targeted selection of the length of the screen, the targeted selection of material, and/or the provision of cooling ducts and/or of a gap in the described manner, so that overall there results a significant increase in the reliability of the laser spark plug.

In further advantageous embodiments of the present invention, it is provided that, in addition or alternatively to the targeted selection of the length of the screen, and in addition or alternatively to the provision of a high degree of thermal conductivity of the screen, and in addition or alternatively to the provision of a gap that is positioned before the combustion chamber window at the combustion chamber side and that communicates with the interior of the screen and whose size is selected to be small in a targeted manner, and in addition or alternatively to the provision of a small exit cross-section of the screen, and in addition or alternatively to the provision of an edge and/or of an extremal cross-section of the type described in each case in a laser spark plug for an internal combustion engine including at least one means for guiding, shaping, and/or for producing laser radiation, further including a combustion chamber window and a housing, the housing having at the side of the combustion chamber window situated opposite the means, in particular at an end of the housing at the combustion chamber side, a screen for the passage of the laser radiation guided, shaped, and/or produced by the means into a combustion chamber, the inner contour of the screen having the shape of the jacket surface of a frustum, the frustum having an opening angle $\phi$, focusing means are provided has for determining a beam divergence angle $\psi$ of the laser radiation passing through the screen, such that $0 \leq \phi - \psi \leq 30°$, in particular $0 < \phi - \psi < 30°$.

The beam shape of the laser radiation, in particular the beam divergence angle, beam position, beam dimensions, and spacings between the beam and the screen, are to be understood in accordance with and/or against the background of the DIN EN ISO 11145 standard. With regard to the embodiment and the effect of the focusing means, the above statements are valid.

The feature that $0 \leq \phi - \psi \leq 30°$, in particular $0 < \phi - \psi < 30°$, results in the technical effect that an exit cross-section of the screen is relatively narrow, so that only few particles can enter into the interior of the screen, but the screen expands relatively strongly in its part facing the combustion chamber window, so that the surface expansion of the inner contour of the screen is relatively large. The surface of the combustion chamber window penetrated by the laser radiation is in contrast relatively small, as a result of the small beam divergence angle $\psi$. These surface relationships have the overall result that the majority of particles that have penetrated into the screen, which from the outset are few, deposit on the screen and not on the combustion chamber window. The deposits on the combustion chamber window are thus reduced, and the reliability of the laser spark plug is increased.

This advantageous effect emerges in particular when the inner contour of the screen has the shape of the jacket surface of a right circular frustum, the right circular frustum having the opening angle $\phi$, where $0 \leq \phi - \leq 30°$, in particular $0 < \phi - \psi < 30°$. In addition, it is preferred that opening angle $\phi$ be 90° or less, in particular 70° or less, preferably 60° or less, and/or that opening angle $\phi$ be 3° or more, in particular 10° or more, and/or that $5° \leq \phi - \psi$, in particular $13° \leq \phi - \psi$, and/or that $\phi - \psi \leq 20°$, in particular $\phi - \psi \leq 15°$.

Both through the selection of $\phi - \psi$ in the described manner and also through further measures described above, in particular the provision of a small exit cross-section of the screen, and through the provision of the described relations between the exit cross-section and the length of the screen, and/or through the adaptation of the inner contour of the screen to the laser beam, in each case in itself a good shielding can already be achieved of the combustion chamber window from conditions prevailing in the combustion chamber. The shielding effect can be further significantly increased through the interaction of these measures, so that overall a significant reduction of deposits results, and there results a significant increase in the reliability of the laser spark plug.

The suitable selection of $\phi - \psi$ in the described manner also enters into mutual amplification of effect with further measures, described above or in the following, that bring about a lowering of the combustion chamber window temperature and/or a reduction of the exposure of the combustion chamber window to particles, in particular the targeted selection of the length of the screen, targeted selection of material, and/or the provision of cooling ducts and/or of a gap in the described manner, so that overall there results a significant reduction of deposits and a significant increase in the reliability of the laser spark plug.

Advantageous further specific embodiments of the present invention, in particular developments of the above-explained specific embodiments, relate to measures for guiding the flow in a region positioned before the screen and/or in the region of the screen and/or in a region of the exit opening of the screen and/or in the screen. These measures can on the one hand relate to a prechamber included in the laser spark plug and situated in particular at the end of the housing at the combustion chamber side, here in particular the targeted situation of at least one transfer duct that enables a fluid connection between an inner space of the prechamber and a combustion chamber surrounding the prechamber. On the other hand, measures for influencing flow in the named regions can also be provided in devices not included in the laser spark plug, for example through the design of the shape of the combustion chamber or of the piston associated with the combustion chamber, or of other components of the internal combustion engine.

It is in particular advantageous, in addition or alternatively to the above-stated measures, in a laser spark plug for an internal combustion engine including at least one means for guiding, shaping, and/or for producing laser radiation, further including a combustion chamber window and a housing, the housing having, at the side of the combustion chamber window situated opposite the means, a screen for the passage of the laser radiation guided, shaped, and/or produced by the means into a prechamber situated at the end of the housing at the combustion chamber side, at least one transfer duct being provided that enables a fluid connection between an inner space of the prechamber and a combustion chamber surrounding the prechamber, that the at least one transfer duct is situated and fashioned such that when a fluid flows through the transfer duct into the inner space of the prechamber there results a desired fluid flow.

For this purpose it can be provided that the at least one transfer duct has a cross-section that is not larger than, in particular is smaller than, the exit cross-section of the screen, and/or is not larger than, in particular is smaller than, a minimum cross-section of the screen. In addition or alternatively, it can be provided that the at least one transfer duct has a cross-section $Q_Ü$ that is not larger than, in particular is smaller than, a maximum cross-section, which maximum cross-section can be 10 $mm^2$, 6 $mm^2$, 4 $mm^2$, 2 $mm^2$, or 1 $mm^2$. The direction of the fluid flowing into the prechamber can be influenced in a particularly targeted fashion through these relatively small cross-sections. Moreover, in addition or alternatively to the targeted influencing of the fluid flowing into the prechamber, it is conducive if the length of the at least one transfer duct $L_Ü$ is large in comparison to a cross-section $Q_Ü$ of the at least one transfer duct, in particular in accordance with $L_Ü > (Q_Ü/\Pi)^{1/2}$, $L_Ü > (16 * Q_Ü/\Pi)^{1/2}$, or $L_Ü > (36 * Q_Ü/\Pi)^{1/2}$. The targeted influencing of the fluid flowing into the prechamber, in particular in one of the ways described in the following, results in a reduction of the deposits on the combustion chamber window, and thus results in an improvement of the reliability of the laser spark plug.

Here, the screen can be understood in particular as a region of the laser spark plug that is situated between the prechamber and the combustion chamber window and that is cylindrical or tapers in the direction of the combustion chamber, while the prechamber can be understood in particular as a region of the laser spark plug situated at the combustion chamber side of the screen that in particular has a cross-section that is enlarged at least in segments relative to the overall screen or to the exit opening of the screen.

In a laser spark plug for an internal combustion engine including at least one means for guiding, shaping, and/or for producing laser radiation, further including a combustion chamber window and a housing, the housing having, at the side of the combustion chamber window situated opposite the means, a screen for the passage of the laser radiation guided, shaped, and/or produced by the means into a prechamber situated at the end of the housing at the combustion chamber side, at least one transfer duct being provided that enables a fluid connection between an inner space of the prechamber and a combustion chamber surrounding the prechamber, it is in particular advantageous that the at least one transfer duct is situated and fashioned in such a way that when a fluid flows through the transfer duct into the inner space of the prechamber there results a fluid flow that enters into the interior of the screen at a finite minimum angle, in particular measured relative to the longitudinal axis of the laser spark plug.

The fact that when a fluid flows through the transfer duct into the inner space of the prechamber there results a fluid flow that enters into the interior of the screen at a finite minimum angle $\epsilon$, in particular measured relative to the longitudinal axis of the laser spark plug, results on the one hand in the effect that the fluid flowing in is diverted onto the inner contour of the screen, and particles contained in the fluid are deposited there. The number of particles that reach the combustion chamber window can in this way be reduced, the deposits on the combustion chamber window are reduced, and the reliability of the laser spark plug is increased.

The described effect already occurs when minimum angle $\epsilon$ is 45°; still more advantageous minimum angles $\epsilon$ are 60° or 75° or 85°, measured in each case relative to the longitudinal axis of the laser spark plug. Alternatively, it is always also possible to measure the minimum angle relative to a perpendicular to the entry surface of the screen and/or to a perpendicular to a surface of the combustion chamber window facing the combustion chamber. In order to achieve this flow, it is preferably provided that the at least one transfer duct is situated such that its longitudinal axis in the radial direction encloses an angle with the longitudinal axis of the laser spark plug that is less than approximately 25°, preferably less than approximately 10°. Alternatively or in addition, a plurality of transfer ducts can be provided. In addition or alternatively, it can be provided that additional means are provided by which a purge gas can be blown into the prechamber, and that these means are situated in such a way and are capable of being operated in such a way that together with the fluid flowing through the transfer bore there results an overall flow that enters into the interior of the screen at the minimum angle as explained above, or that is at least largely parallel to an exit opening of the screen. It is always preferable for the flow inside the prechamber to be realized as a tumble flow.

For a given minimum angle $\epsilon$, the above-explained effect of the provision of the minimum angle $\epsilon$ works together synergetically with a particularly long screen and/or with a particularly slim screen, in particular a screen having a small exit cross-section $Q_{BA}$ through which the fluid flow enters into the interior of the screen, because in such developments the inner contour of the screen is impinged on by the fluid flow particularly close to its end at the combustion chamber side, and particles preferably deposit there on the inner contour of the screen. It is preferable that the inner contour of the screen be impinged on by the fluid flow in a half of the inner contour of the screen that faces the combustion chamber. Still more favorable is an impinging of the fluid flow in an end segment facing the combustion chamber whose length in the longitudinal direction of the inner contour is 1/n of the overall length of the inner contour of the screen, where it can be the case that n=3 or n=4 or n=5. A similar situation can also be expressed in that minimum angle $\epsilon$, the length of the screen L, relation number n, and the exit cross-section of the screen $Q_{BA}$ fulfill one of the following conditions:

$$n^*\tan\epsilon = L/(Q_A/\Pi)^{1/2};\ n=2\ldots5.$$

The provision of a minimum angle also enters in the described manner into mutual amplification of effect with the further measures described above or in the following that bring about a lowering of the combustion chamber window temperature and/or a reduction of the exposure of the combustion chamber window to particles, in particular the targeted selection of the length of the screen, targeted selection of material, and/or provision of cooling ducts and/or of a gap in the described manner, so that overall there results a significant reduction of deposits and a significant increase in the reliability of the laser spark plug.

In a laser spark plug for an internal combustion engine including at least one means for guiding, shaping, and/or for producing laser radiation, further including a combustion chamber window and a housing, the housing having at the side of the combustion chamber window situated opposite the means, in particular at an end of the housing at the combustion chamber side, a screen for the passage of the laser radiation guided, shaped, and/or produced by the means into a prechamber situated at an end of the housing at the combustion chamber side, at least one transfer duct being provided that enables a fluid connection between an inner space of the prechamber and a combustion chamber surrounding the prechamber, it is in particular advantageous that the at least one transfer duct is situated and fashioned in such a way that when a fluid flows through the transfer duct into the inner space of the prechamber there results a fluid flow that has, in the region of the screen, at least one swirl that rotates about a swirl axis that has a component in the direction of the longitudinal axis of the laser spark plug.

Here, the region of the screen is to be understood in particular as a region positioned before the screen and/or a region of the exit opening of the screen. Regions are to be understood in particular as spatial areas having structural lengths that are somewhat smaller than, for example half as large or one-fourth as large as, a structural length of the inner contour of the screen; the structural length can be given in particular through length, entry diameter, and/or exit diameter of the screen.

From such a configuration and design of the transfer duct, or of the flow ducts, it first results that the fluid flow in the region of the screen has a component in the direction perpendicular to longitudinal axis LA of the laser spark plug. In addition, the swirl causes a local deflection of flow in a direction perpendicular to the local flow speed. Because the particles transported by the flow have a finite inertia, they follow this flow deflection only to a certain extent, and tend, in particular given a sharp flow deflection, to impinge on the inner contour of the screen or on a side wall of the prechamber. The overall result is that the quantity of particles reaching the combustion chamber window is reduced, so that deposits on the combustion chamber window are reduced, and the reliability of the laser spark plug is increased.

Although the described technical effect results already when the swirl axis has only one component in the direction of the longitudinal axis of the laser spark plug, it is preferable that the swirl axis enclose an angle with a longitudinal axis of the laser spark plug of at most 45°, in particular at most 20°, preferably at most 10°, or that it be parallel to longitudinal axis LA of the laser spark plug. In the case in which the swirl axis is parallel to longitudinal axis LA of the laser spark plug, in addition to the coaxial situation a spaced situation of the swirl axis and longitudinal axis LA of the laser spark plug is also favorable, in particular if the spacing between the swirl axis and longitudinal axis LA of the laser spark plug is at least 2 mm, in particular at least 4 mm. Possible maximum spacings are 6 mm and 10 mm. The result of the spacing is a shear current perpendicular to the exit opening of the screen, and the impinging of the particles on the inner contour of the screen.

The provided situation of the transfer duct can in particular have the result that its longitudinal axis in the tangential direction encloses an angle with the longitudinal axis of the laser spark plug that is more than approximately 10°, preferably more than approximately 25°.

In addition or alternatively, it can be provided that additional means are provided by which a purge gas can be blown into the prechamber, the additional means being situated in such a way and capable of being operated in such a way that together with the fluid flowing through the transfer bore there results an overall flow that forms a swirl as explained above. It is always preferable for the flow to be realized inside the prechamber as a swirl flow.

For a given swirl, the above-explained effect of the provision of a swirl works together synergetically with a particularly long screen and/or with a screen having a particularly slim geometry, in particular a screen having a small exit cross-section $Q_{BA}$ through which the fluid flow enters into the interior of the screen, because in such developments the particles that are tangentially accelerated away impinge on the inner contour of the screen particularly close to its end at the combustion chamber side. It is preferable that the particles that are tangentially accelerated away impinge on the inner contour of the screen in a half of the inner contour of the screen facing the combustion chamber. Still more favorable is an impinging of the particles tangentially accelerated away in an end segment facing the combustion chamber, whose length in the longitudinal direction of the inner contour is 1/n of the overall length of the inner contour of the screen, where it can be the case that n=3 or that n=4 or that n=5.

A similar situation can also be expressed in that maximum angle ν formed by the swirl axis with the longitudinal axis of the laser spark plug, the length of the screen L, relation number n, and the exit cross-section of the screen $Q_{BA}$ fulfill one of the following conditions:

$$n^{*}\tan \nu = L/(QA/\Pi)^{1/2};\ n=2 \ldots 5.$$

The situation and construction of a transfer duct in the indicated manner also enters into mutual amplification of effect with the further measures described above or in the following that bring about a lowering of the combustion chamber window temperature and/or a reduction of the exposure of the combustion chamber window to particles, in particular the targeted selection of the length of the screen, targeted selection of material, and/or provision of cooling ducts and/or of a gap in the described manner, so that overall there results a significant reduction of deposits and a significant increase in the reliability of the laser spark plug.

In a laser spark plug for an internal combustion engine including at least one means for guiding, shaping, and/or for producing laser radiation, further including a combustion chamber window and a housing, the housing having at the side of the combustion chamber window situated opposite the means, in particular at an end of the housing at the combustion chamber side, a screen for the passage of the laser radiation guided, shaped, and/or produced by the means into a combustion chamber, it is in particular advantageous that the screen have, on a side facing the combustion chamber, at least one outer edge whose contour deviates inward relative to a sharp-edged outer edge.

With regard to the term "sharp-edgedness," reference is made to the standard DIN ISO 13715:2000. In particular, an outer edge is to be understood as sharp-edged if it has only denudations or transitions that are 50 μm or less.

The outer edge of the screen can in particular border the inner contour of the screen. However, on the other hand the outer edge of the screen can in particular also be situated at a distance from the inner contour of the screen, and in particular can represent a radially outwardly situated limitation of the screen and/or of the housing at its end at the combustion chamber side.

The provision of the deviation of the contour of the outer edge inward is based on the recognition that during operation in an internal combustion engine, laser spark plugs are exposed, at the combustion chamber side, to the high temperatures prevailing in the combustion chamber. On the other hand, through thermal coupling of the laser spark plug at its side facing away from the combustion chamber, there takes place a flowing away of heat, so that the rise in the temperature of the laser spark plug is limited. It was recognized that the flowing away of heat in the area of the laser spark plug is worsened in particular from sharp outer edges situated at the combustion chamber side, and as a result particularly high temperatures occur in these areas that can result in the occurrence of glow ignitions in the combustion chamber, and thus to worsened operation of the internal combustion engine. Through the deviation of the contour of the outer edge inward, regions having such high temperature increases are avoided, and as a result the occurrence of glow ignitions in the combustion chamber can be avoided.

Although the described technical effect results already if the screen has at least one outer edge on its side facing the combustion chamber whose contour deviates inward relative to a sharp-edged outer edge, it is preferred that the outer edge proceed from a sharp-edged outer edge through a denudation of more than 0.075 mm, in particular 0.1 mm or more, preferably 0.15 mm or more. Possible upper limits for the denudation are 5 mm, 2 mm, and 0.5 mm, because denudations that are too large can impair the mechanical stability of the screen.

In preferred embodiments, it is provided that the outer edge of the screen has a rounding and/or a chamfer. Here it is further preferred that in the case of a rounding the rounding radius, and in the case of a chamfer the depth and/or the width of the bevel, be 0.075 mm or more, in particular 0.15 mm or more. In addition or alternatively it is preferred that in the case of a rounding the rounding radius, and in the case of a chamfer the depth and/or width of the bevel, be 5 mm or less, in particular 2 mm or less, preferably 0.5 mm or less. Bevel angles in the range between 20° and 70°, in particular in the range between 40° and 50°, are preferred.

Of particular importance is the provision of the deviation of the contour of the outer edge inward, in particular the rounding and/or the chamfer in screens having a long length, because these screens are particularly exposed to the combustion chamber and are therefore particularly liable to an excessive temperature increase. Such an excessive temperature increase can be avoided particularly effectively if the screen, at least in the area of the outer edge, is made of a material having a high thermal conductivity, in particular brass, nickel, and/or copper, or an alloy of at least two of these materials.

An advantageous development of the laser ignition device according to the present invention provides that the screen is fashioned as a separate component and is fastened to a further part of the housing of the laser spark plug, in particular to a shoulder. It is preferable to ensure a good conducting of heat away from the screen, which can take place by making the join point between the screen and a further part of the housing so as to have good thermal conductivity, in particular via a large-surface soldering (at least 10 $mm^2$, in particular at least 20 $mm^2$) and/or by omitting welded connections, for example through a press-fit connection. Alternatively or in addition, the screen can also be screwed to the further part of the housing using a threading, it being preferable to provide a screwed connection having a fine threading (thread pitch ≤0.5 mm, in particular ≤0.3 mm).

In principle, it is possible to use the laser spark plug to produce an ignition spark inside the screen. However, the production of an ignition spark in a region positioned before the screen at the combustion chamber side, in particular in a combustion chamber or a prechamber, is more advantageous, because in this way quenching losses during ignition can be avoided. Preferably, here an ignition spark is produced at least 1 mm, preferably at least 2 mm, outside the screen. Possible upper limits for the spacing between the ignition spark and the exit surface of the screen are, additionally or alternatively, 30 mm, 10 mm, and 5 mm, because otherwise the exit cross-section of the screen would have to be selected excessively large, or an adequate focusing of the laser radiation would be made more difficult. The position of a focus of the laser radiation produced or shaped by the laser spark plug can in particular be regarded as the position of the ignition spark.

In principle, the scope of the present invention also includes, as a special case of a combustion chamber, a prechamber that is fixed to the laser spark plug or is capable of being fixed to the laser spark plug, in particular a prechamber whose volume is less than 10 $cm^3$ and that has at least one transfer duct whose cross-section is less than 5 $mm^2$.

DETAILED DESCRIPTION OF THE INVENTION

Figure 1A:
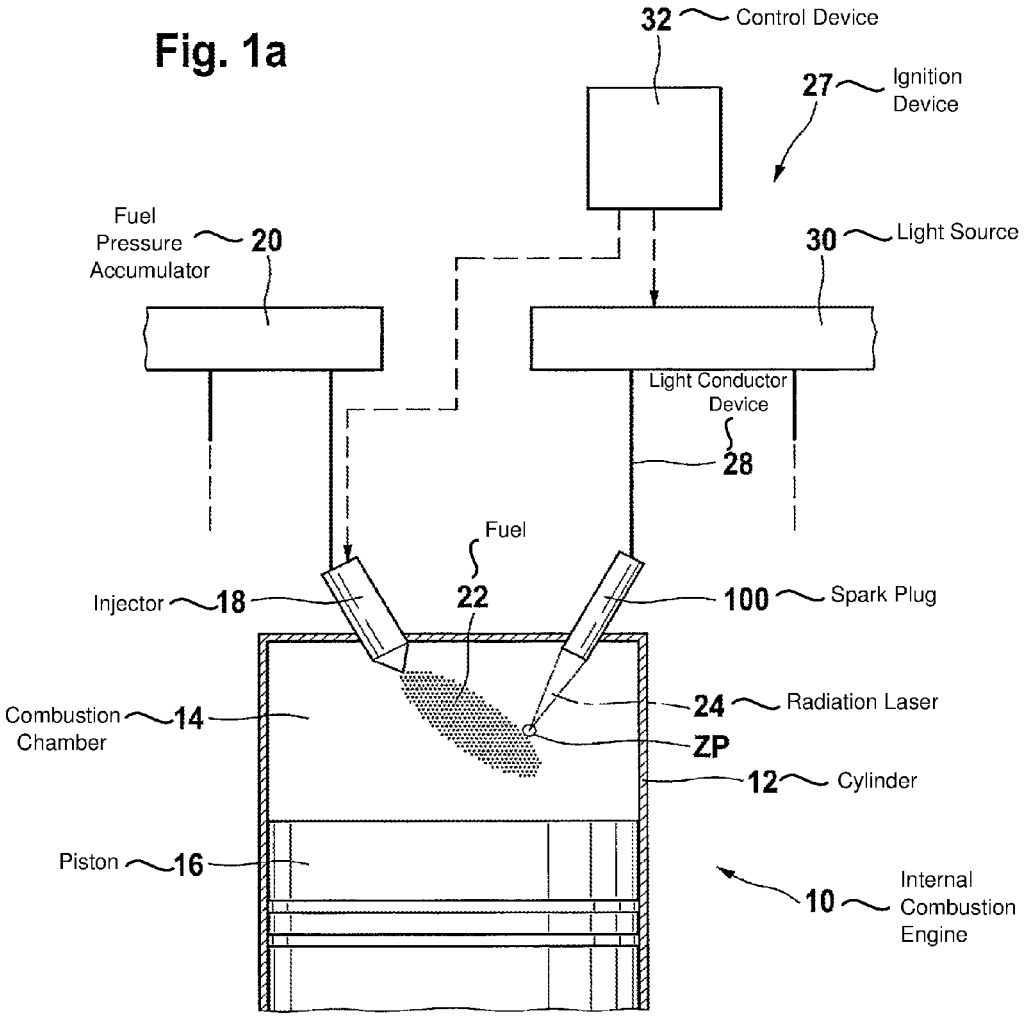
FIG. 1*a* shows a schematic representation of an internal combustion engine having a laser ignition device.

In FIG. 1*a*, an internal combustion engine is designated 10 overall. It can be used to drive a motor vehicle (not shown). Internal combustion engine 10 has a plurality of cylinders, of which FIG. 1 shows only one, designated by reference character 12. A combustion chamber 14 of cylinder 12 is limited by a piston 16. Fuel, or a previously mixed fuel-air mixture, moves into combustion chamber 14 through an injector 18, which is connected to a fuel pressure accumulator 20 also referred to as a rail.

Fuel 22, or a previously mixed fuel-air mixture, injected into combustion chamber 14 is ignited by a laser radiation 24 that is radiated into combustion chamber 14 by an ignition device 27 that includes a laser spark plug 100. For this purpose, laser spark plug 100 is supplied with light via a light conductor device 28; this light can in particular be pumped light provided by a light source 30. Light source 30 can also immediately provide light provided for the ignition. Light source 30 is controlled by a control device 32 that also controls injector 18.

Figure 1B:
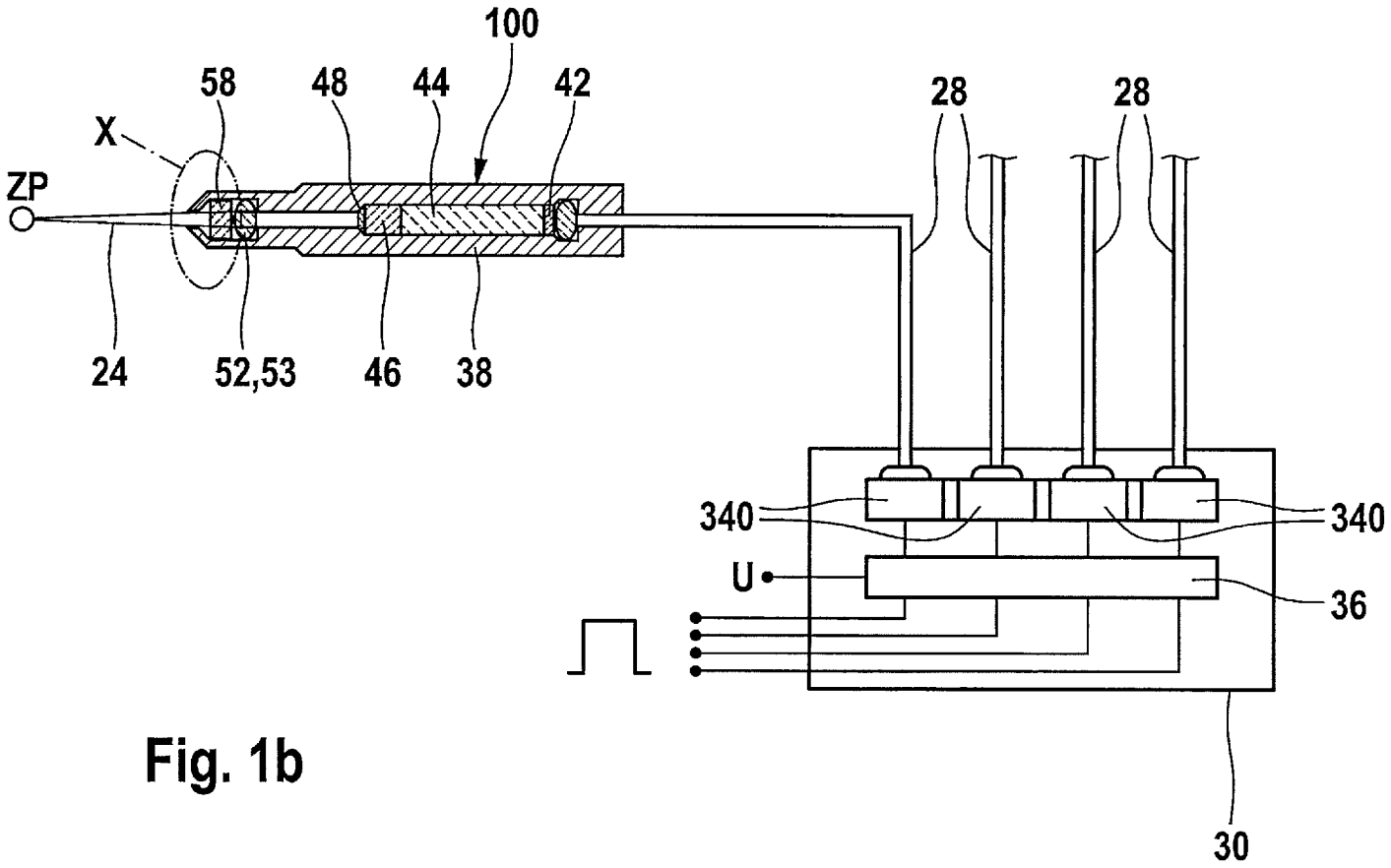
FIG. 1*b* shows a schematic representation of the laser ignition device of FIG. 1.

As can be seen in FIG. 1*b*, light source 30 feeds a plurality of light conductor devices 28 for various laser spark plugs 100, each of which is allocated to a cylinder 12 of internal combustion engine 10. For this purpose, light source 30 has a plurality of individual laser light sources 340 connected to a pulsed power supply 36. The presence of the plurality of individual laser light sources 340 realizes a so to speak "static" distribution of light, in particular pumped light, to the various laser spark plugs 100, so that no optical distributors or the like are required between light source 30 and laser spark plugs 100. Alternatively, light source 30 may also have only one laser light source 340. In particular, exactly one light source 30 and/or exactly one laser light source 340 is allocated to each laser spark plug 100.

Laser spark plug 100 has for example a laser-active solid element 44 having a passive Q-switching 46, which together with a coupling-in mirror 42 and a coupling-out mirror 48 forms an optical resonator. Optionally, further optical components, in particular lenses, can be provided, for example for shaping the radiation supplied to laser spark plug 100, or for broadening radiation.

When supplied with light produced by light source 30, in particular pumped light, laser spark plug 100 produces laser radiation 24 in a known manner, which is focused by a focusing optics 52 onto an ignition point ZP situated in combustion chamber 14 (FIG. 1*a*). The components present in housing 38 of laser spark plug 100 are separated from combustion chamber 14 by a combustion chamber window 58.

FIGS. 2 through 21*a* show detail X of FIG. 1*b*, i.e. end 381, facing combustion chamber 14, of housing 38 of laser spark plug 100, in a greatly enlarged view and in partial longitudinal section. This greatly enlarged view clearly shows that combustion chamber window 58 is connected to housing 38 in sealing fashion. The seal between housing 38 and combustion chamber window 58 can be made in the area of reference character 60 in the form of a material connection or non-positive connection.

As in these examples, housing 38 can have a two-part construction. It includes an inner sleeve 62 and an outer sleeve 64. At its end facing combustion chamber 14 (see FIG. 1*a*), outer sleeve 64 has a shoulder 66. In particular in the case of the non-positive connection, shoulder 66 is used to press combustion chamber window 58 against inner sleeve 62, thus increasing the sealing in the area of connection 60. Sealing means, for example sealing rings, in particular steel sealing rings, preferably copper-coated steel sealing rings, may also be used, and in particular may be favorable for the compensation of thermal expansion between the window material and the surrounding material.

In this example, an internal thread is provided on outer sleeve 64 that interacts with a corresponding external thread on inner sleeve 62. This threading, made up of internal thread and external thread, is designated overall by reference character 68. The interlocking of external sleeve 64 and internal sleeve 62 creates a further sealing surface 72 between shoulder 66 and combustion chamber window 58.

In principle, in addition to the types of seals shown in these examples, other types of seals of combustion chamber window 58 are also possible, for example such as those in which, as described in DE 102009000540 A1, a material-fit seal is provided between the combustion chamber window and a surrounding material.

Inside housing 38, at the side of combustion chamber window 58 facing combustion chamber 14 there is a focusing optics 52 (see FIGS. 1*a* and 1*b*) that focuses laser radiation 24, produced in laser spark plug 100 or fed into laser spark plug 100, onto ignition point ZP, which in this example corresponds to the focal point of focusing optics 52. At end 381 at the combustion chamber side of housing 38, there is provided a screen 74 for the passage of laser radiation 24 into combustion chamber 14.

Figure 2:
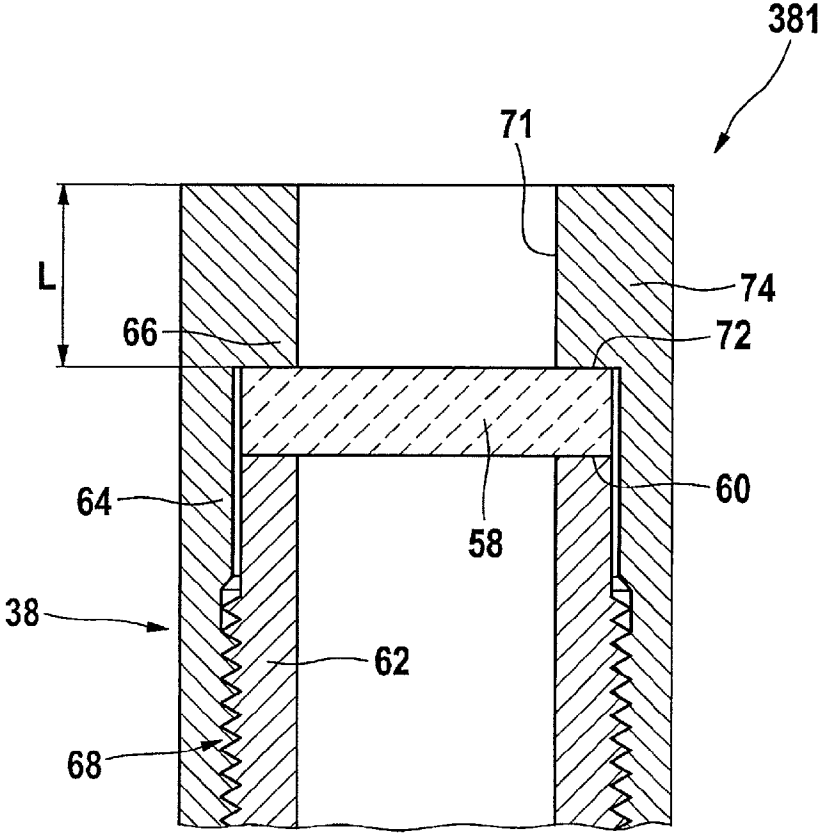

Laser spark plug 100 shown in FIG. 2 has a housing 38 whose segment situated at the combustion chamber side of combustion chamber window 58 is made in the shape of a sleeve and represents a screen 74 according to the present invention. Inner contour 71 of screen 74 has for example the shape of a cylindrical jacket whose height corresponds to length L of screen 74. Here, length L is measured in the longitudinal direction of the laser spark plug, e.g. starting from combustion chamber window 58, and in this example is 13 mm.

Figure 3:
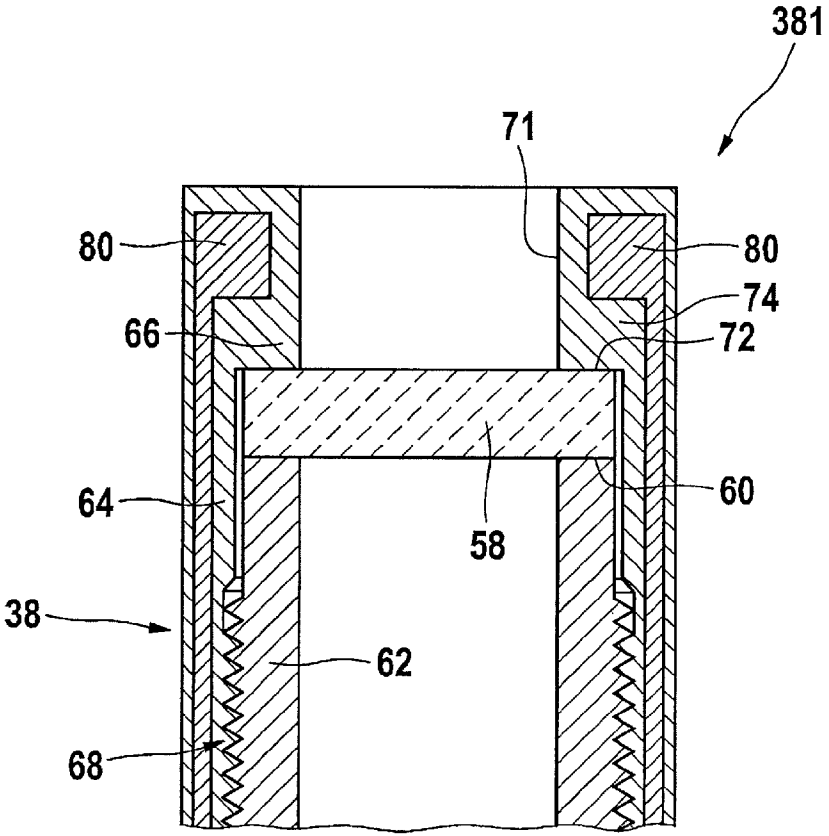
FIGS. 2 through 21 show specific embodiments of laser spark plugs according to the present invention.
Figure 4:
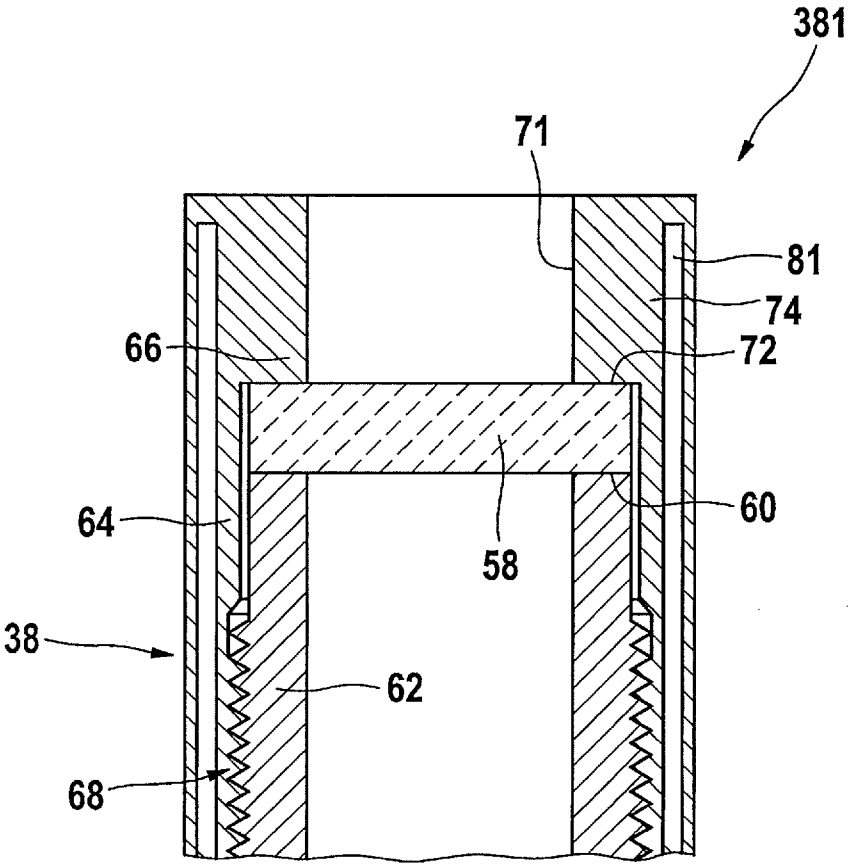
Figure 7:
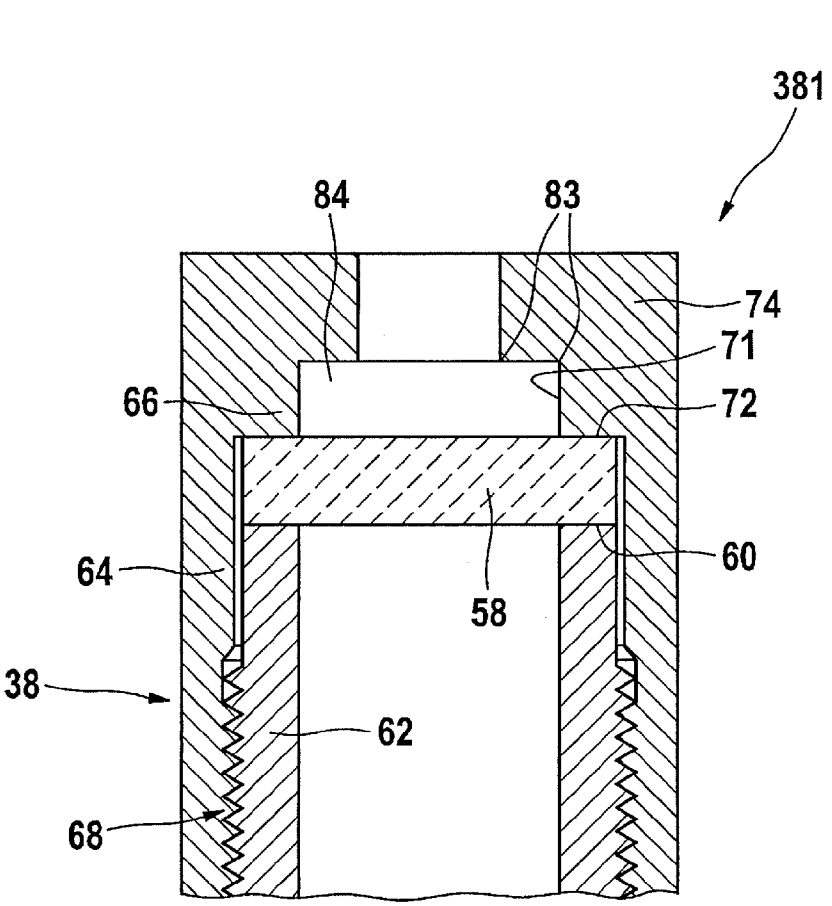

In this example it is further provided that screen 74 is made of a material having a thermal conductivity of 60 W/(m*K) or more, or even a thermal conductivity of 80 W/(m*K) or more, for example of brass, nickel, or copper, or an alloy including at least one of these materials. For this purpose, in this example the entire housing 38 is made of this material. Alternatively, it would also be possible to provide this material only in the region of end 381 of housing 38 at the combustion chamber side. It is also possible to provide the material only in the interior of the screen, surrounded by different material whose thermal conductivity can be lower, for example a high-alloy steel. Such a variant is shown in FIG. 3, and has in the interior of screen 74 an insert 80 that is made for example of copper and through which a rapid conducting of heat away from the region of screen 74 into a further region of housing 38 facing away from combustion chamber 14 is possible. In a further alternative, at the point of insert 80 there are provided cooling ducts 81 in the interior of screen 74, as shown in FIG. 4. Through these cooling ducts 81, heat can be conducted away from the region of screen 74 into a further region, facing away from combustion chamber 14, of housing 38, for example through the circulation of water or some other cooling medium.

Figure 5:
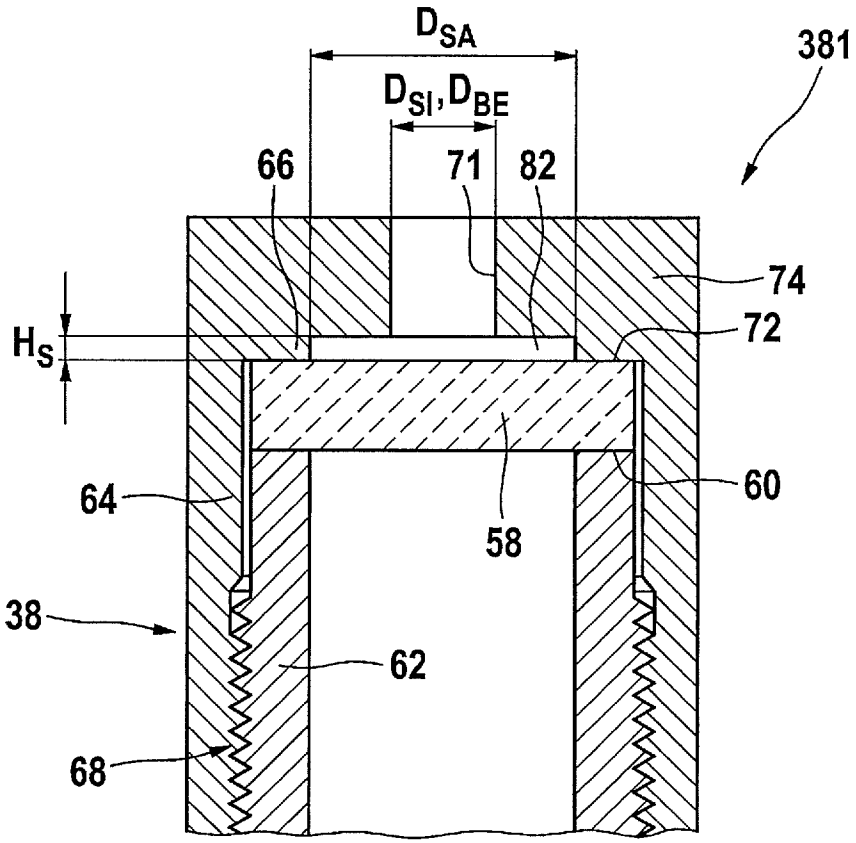

FIG. 5 shows an example of a laser spark plug that differs from those previously shown in that a gap 82 is positioned before combustion chamber window 58 at the combustion chamber side. In this example, gap 82 is limited axially at the side facing combustion chamber 14 by screen 74, and is limited at the side facing away from combustion chamber 14 by combustion chamber window 58, and is outwardly limited by screen 74. Inwardly, gap 82 communicates, via the interior of screen 74, with a region situated before screen 74, for example a combustion chamber 14. Gap 82 has in this example the base surface of a ring having an outer diameter $D_{SA}$ of 15 mm and having an inner diameter $D_{SI}$ of 6 mm, so that gap cross-section $Q_S$ is 148 $mm^2$. Gap cross-section $Q_S$ is thus a multiple of entry cross-section $Q_{BE}$, which is 28 $mm^2$, with an entry diameter $D_{BE}$ of screen 74 of 6 mm. In this example, height $H_S$ of gap 82 is 0.15 mm.

In another example, relevant in particular for laser spark plugs provided for use in internal combustion engines whose lubrication makes use of low-additive oils, or whose lubrication makes use of oils without additives, the height of the gap is 2 mm and gap cross-section $Q_S$ is only 20% of entry cross-section $Q_{BE}$ of screen 74, namely 0.56 $mm^2$.

Figure 6:
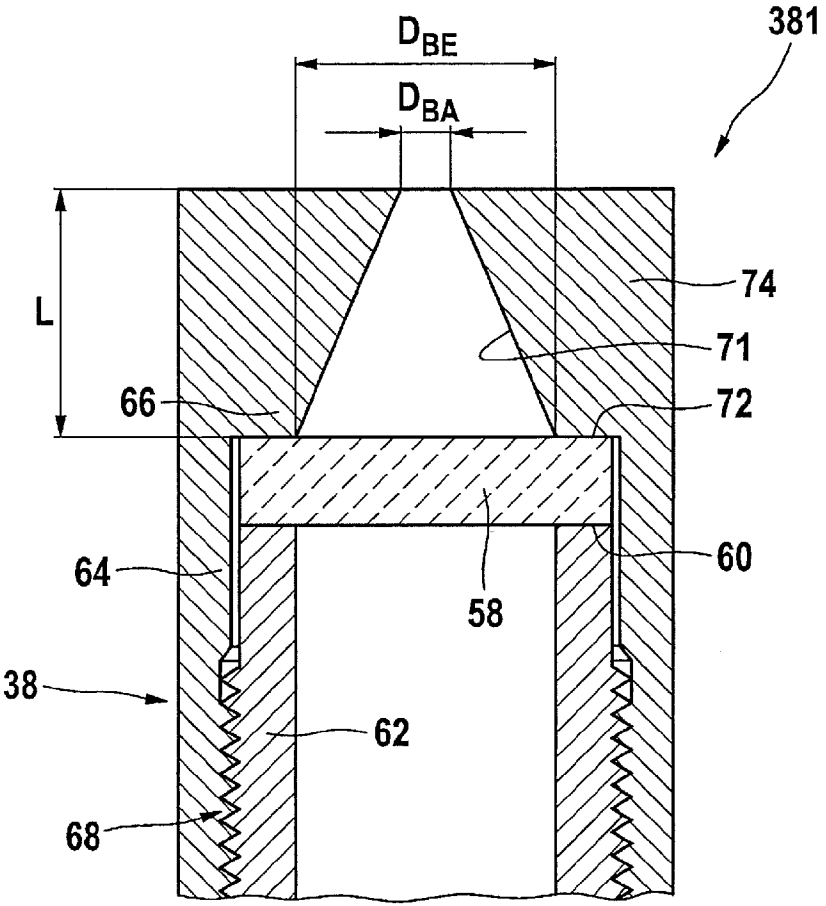

FIG. 6 shows a further example of a laser spark plug 100, differing from those previously shown in that screen 74 has a particularly small exit cross-section $Q_{BA}$, in this example 3 $mm^2$, with an exit diameter $D_{BA}$ of the screen of 2 mm. In this example, length L of screen 74 is 12 mm, so that the value 6 results for the quotient $L/(4Q_{BA}/\Pi)^{1/2}$.

Figure 9:
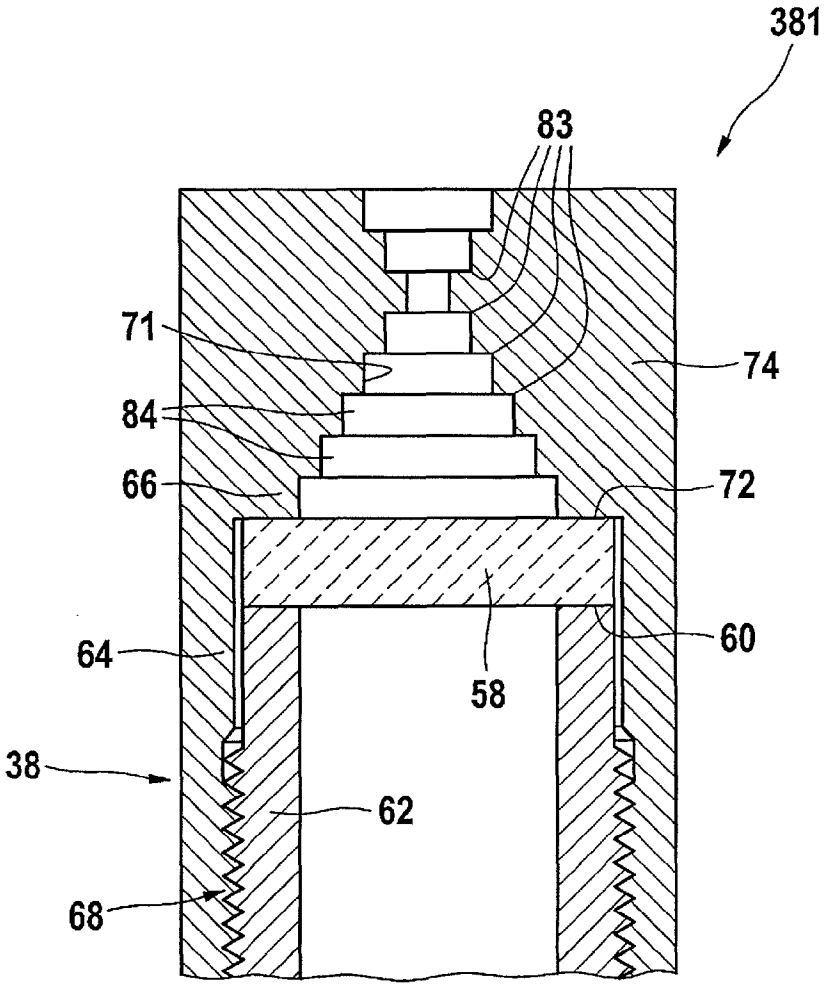
Figure 8:
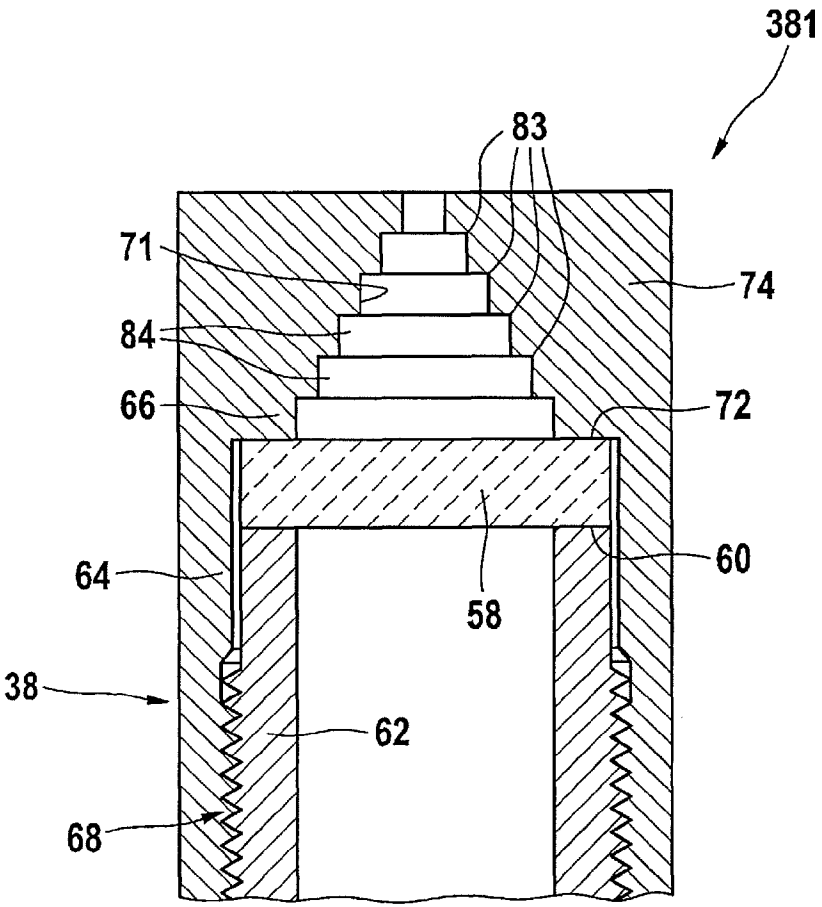

FIGS. 7 through 10 each show a further example of a laser spark plug differing from those shown above in that the inner contour of screen 74 has at least one edge 83, in particular a multiplicity of edges 83, in a region that is situated at a distance both from the end of screen 74 facing the combustion chamber and from the end of screen 74 facing away from the combustion chamber. Laser spark plug 100 shown in FIG. 7 has a screen 74 that in a centric area has two edges 83, an inner edge and an outer edge, which together form a right-angled step 84. FIG. 8 shows a laser spark plug 100 that has a multiplicity of edges 83 and right-angled steps 84 formed from them; here the actually depicted number of steps 84 is to be understood as also representing 3, 7, or 8 steps, situated in particular in a centric region of screen 74. Non-right-angled steps 84 are also possible. In addition to the above-shown steps 84, by which screen 74 tapers in the direction of its end facing combustion chamber 14, steps 84 are also possible by which screen 74 tapers in the direction of its end facing away from combustion chamber 14. FIG. 9 shows an example in which such steps 84, by which screen 74 tapers in the direction of its end facing combustion chamber 14, have an upstream situation at the combustion chamber side.

Figure 10:
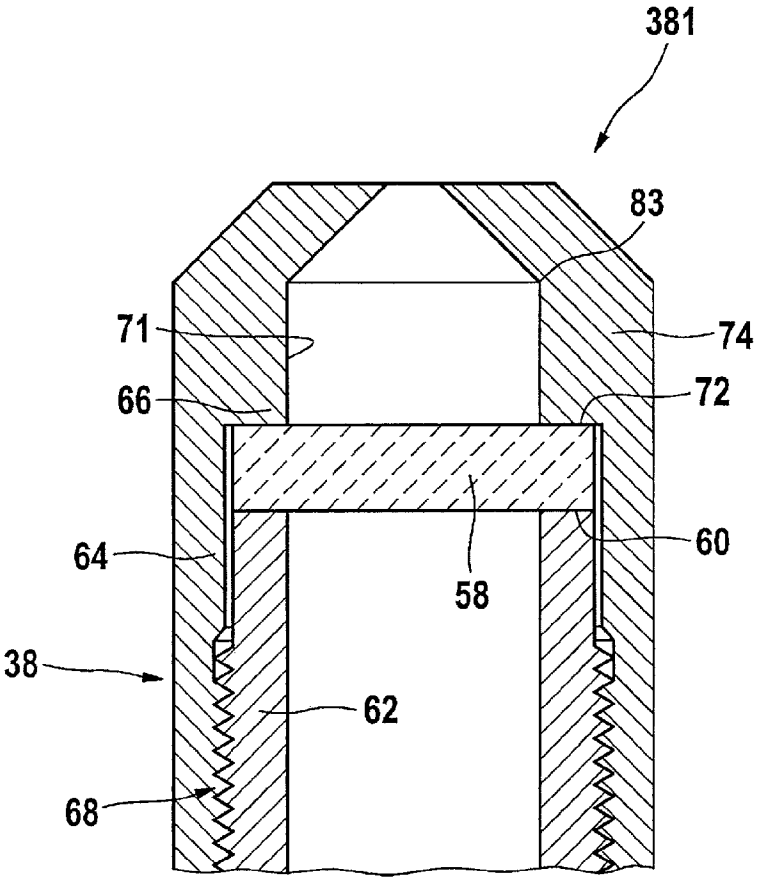

FIG. 10 shows a further example of a laser spark plug 100 having a screen 74 whose inner contour 71 has a circumferential edge 83.

FIGS. 11 through 15 each show an example of a laser spark plug 100 having a screen 74 having the particular feature that inner contour 71 of screen 74 has an extremal cross-section $Q_X$ in a region that is situated at a distance both from the end of screen 74 facing combustion chamber 14 and from the end of screen 74 facing away from combustion chamber 14.

Figure 11:
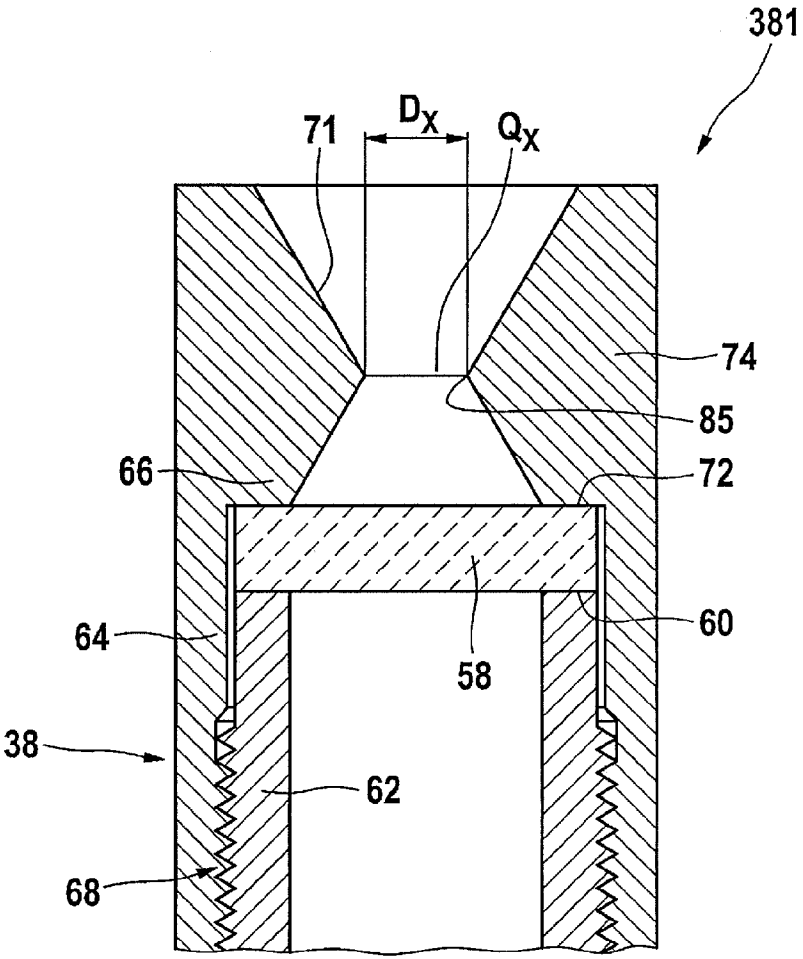

Laser spark plug 100 shown in FIG. 11 has a screen 74 that has, in a centric region, a sharp-edged constriction 85. In the region of constriction 85, diameter $D_X$, and thus the cross-section of screen $Q_X$, is minimal, namely approximately half as large or one-fourth as large as, respectively, entry and exit cross-section $Q_{BE}$, $Q_{BA}$ of the screen. In this example, above and below sharp-edged constriction 85, inner contour 71 of screen 74 has in each case the shape of right circular frustum jackets. Alternatively, it is also possible for constriction 85 to be rounded; see FIG. 12.

Figure 13:
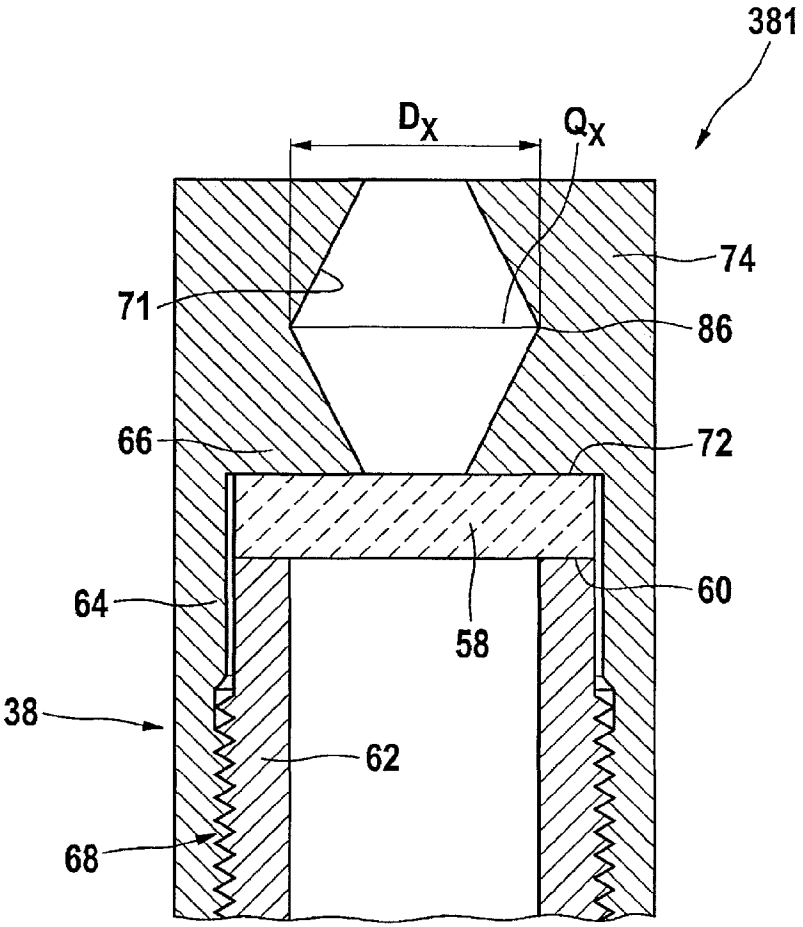
Figure 12:
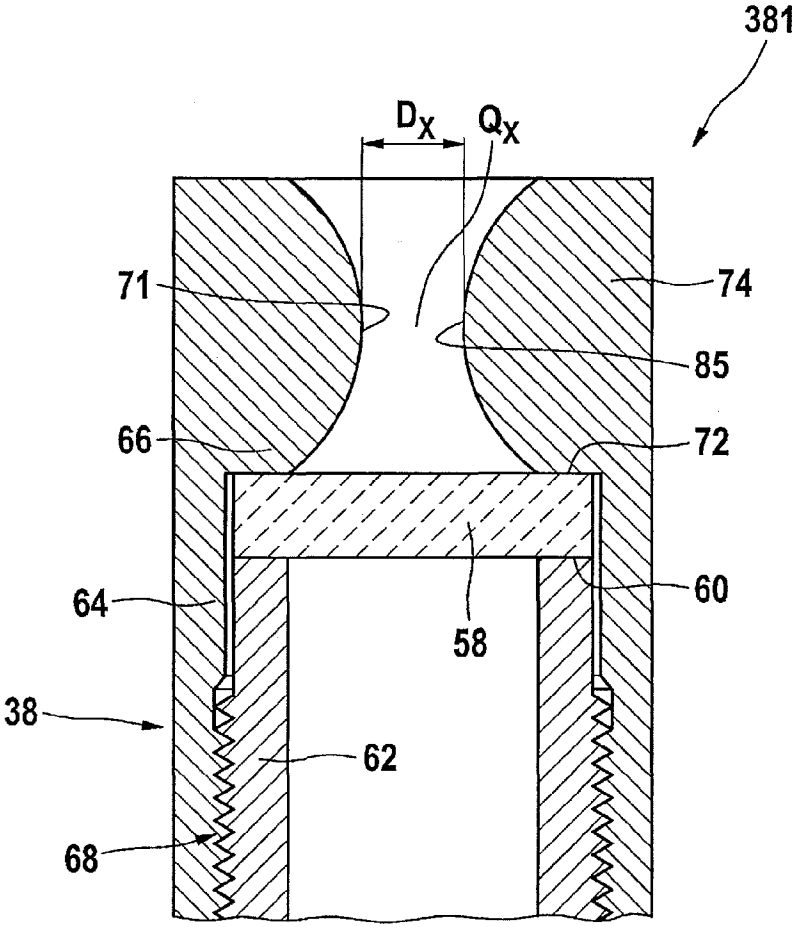
Figure 15:
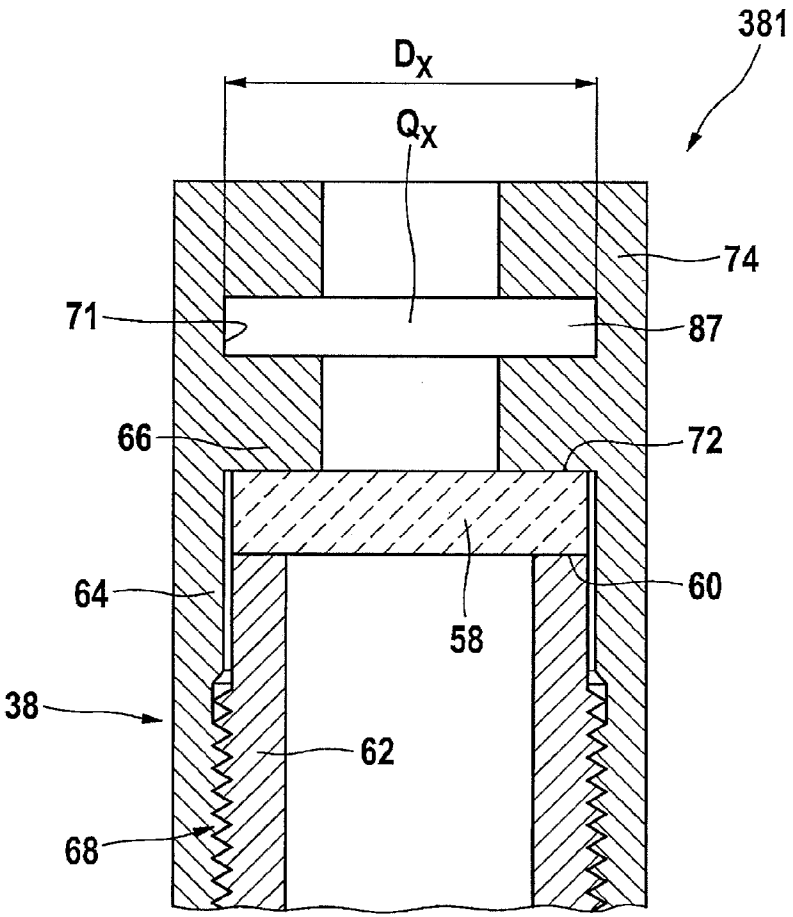
Figure 14:
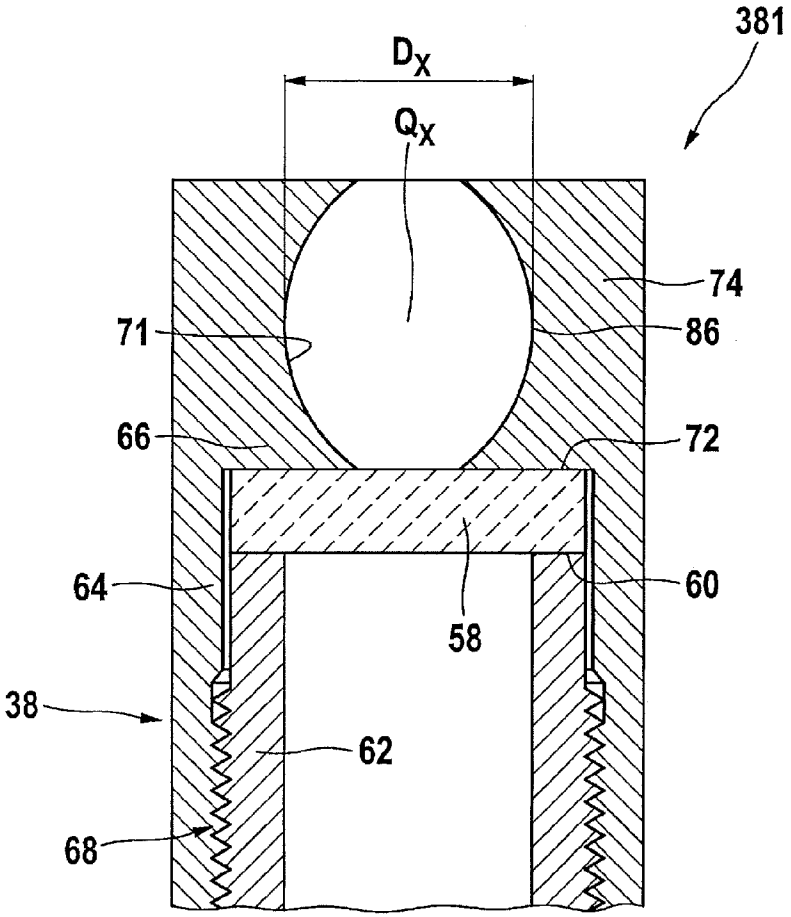

Laser spark plug 100 shown in FIG. 13 has a screen 74 that has in a centric region a sharp-edged bulge 86. In the region of bulge 86, diameter $D_X$, and thus screen cross-section $Q_X$, is maximal, namely approximately twice as large to four times as large as, respectively, entry and exit cross-section $Q_{BE}$, $Q_{BA}$ of the screen. In this example, above and below sharp-edged bulge 86, inner contour 71 of screen 74 has in each case the shape of right circular frustum jackets. Alternatively, it is also possible for a bulge 86 to be rounded; see FIG. 14. FIG. 15 shows a further variant in which screen 74 has a recess 87. In this example, the recess is realized as an inner right-angled recess, and has a maximum screen cross-section $Q_X$ that is approximately twice as large to four times as large as, respectively, entry and exit cross-section $Q_{BE}$, $Q_{BA}$ of the screen.

Extremal cross-sections $Q_S$ shown in FIGS. 11 through 15 are also possible in the other specific embodiments and examples of the present invention, where they are not explicitly excluded. In particular, an extremal cross-section $Q_S$, indicated in exemplary fashion as cylindrical or frustum-shaped, or rounded off overall, can be provided in one of the described ways in inner contours 71 of screen 74.

Figure 17:
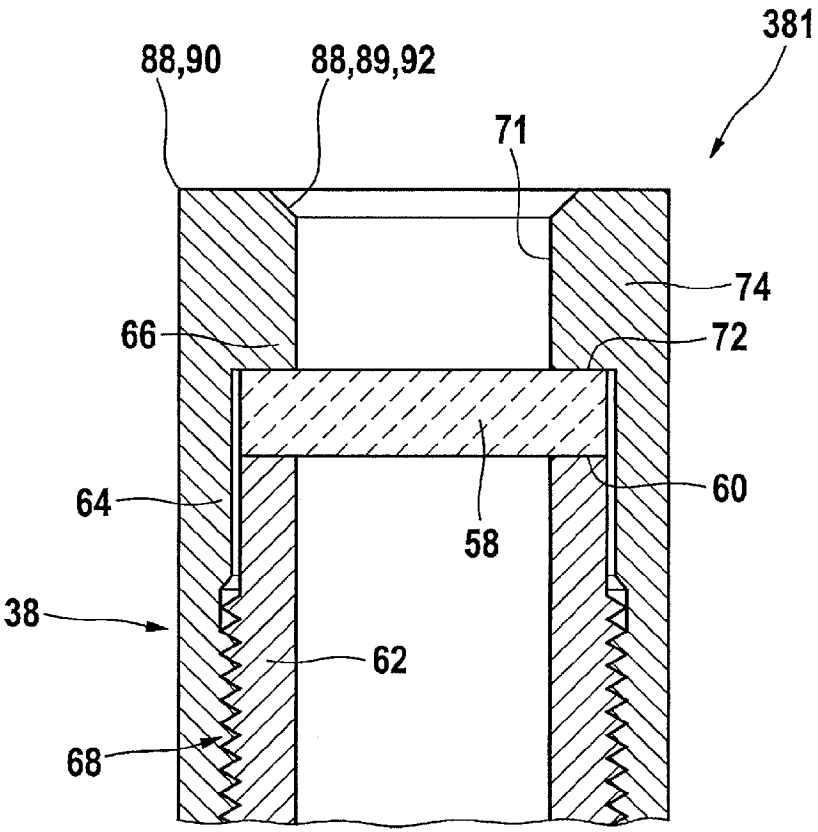
Figure 16:
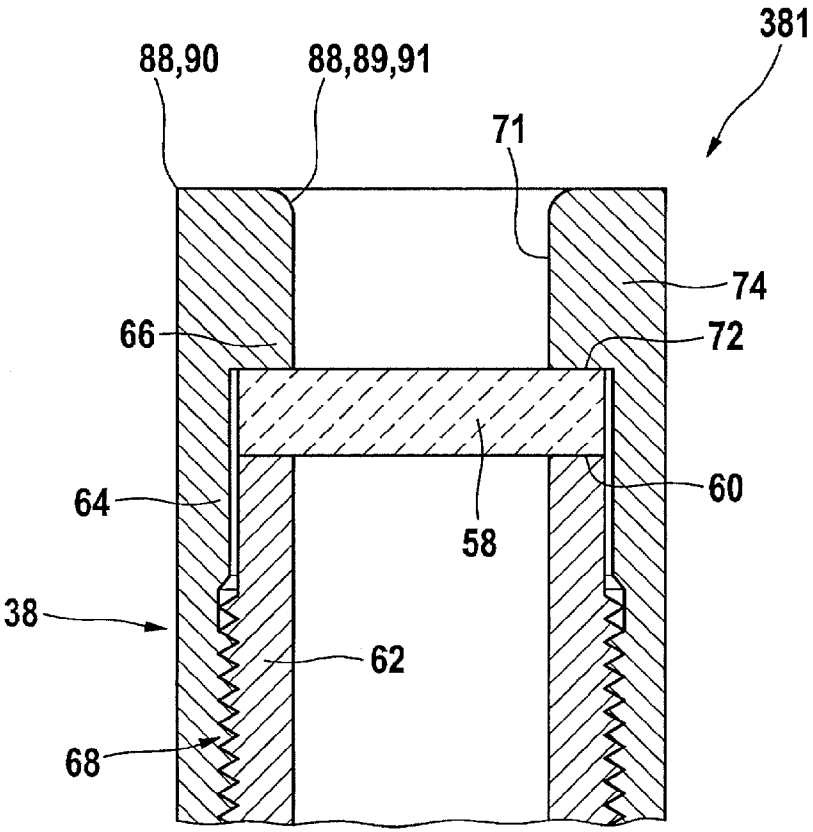

FIGS. 16 and 17 each show a further example of a laser spark plug 100 having a screen 74, having the particular feature that screen 74 has on its side facing combustion chamber 14 at least one outer edge 88 whose contour deviates inward relative to a sharp-edged outer edge. Laser spark plug 100 shown in FIG. 16 has a screen 74 having a sleeve-shaped basic shape, inner edge 89 of the screen at the combustion chamber side having a rounding 91. In this example, the rounding radius is 0.5 mm. Also possible, in addition or alternatively, is a rounding 91 of outer edge 90 of the sleeve at the combustion chamber side, for example with a rounding radius of 0.5 mm. Smaller and/or larger rounding radii are also possible in principle. Laser spark plug 100 shown in FIG.

17 has a screen 74 having a sleeve-shaped basic shape, inner edge 89 of the sleeve at the combustion chamber side having a chamfer 92. In this example chamfer 92 (length and width) is 0.5 mm, and the bevel angle is 45°. Also possible, in addition or alternatively, is chamfering 92 of outer edge 90 of the sleeve at the combustion chamber side, for example with a length and width of 0.5 mm each. Smaller and/or larger chamfers 92 are also possible in principle. Of course, in addition to the outer edges 88 shown in FIGS. 16 and 17, further outer edges 88 can be realized whose contour deviates inward relative to a sharp-edged outer edge, for example outer edges having a shape that is precisely or approximately elliptical, parabolic, or hyperbolic, or having an irregular shape. Combinations of chamfers 92 and roundings 91 are also conceivable.

Figure 19:
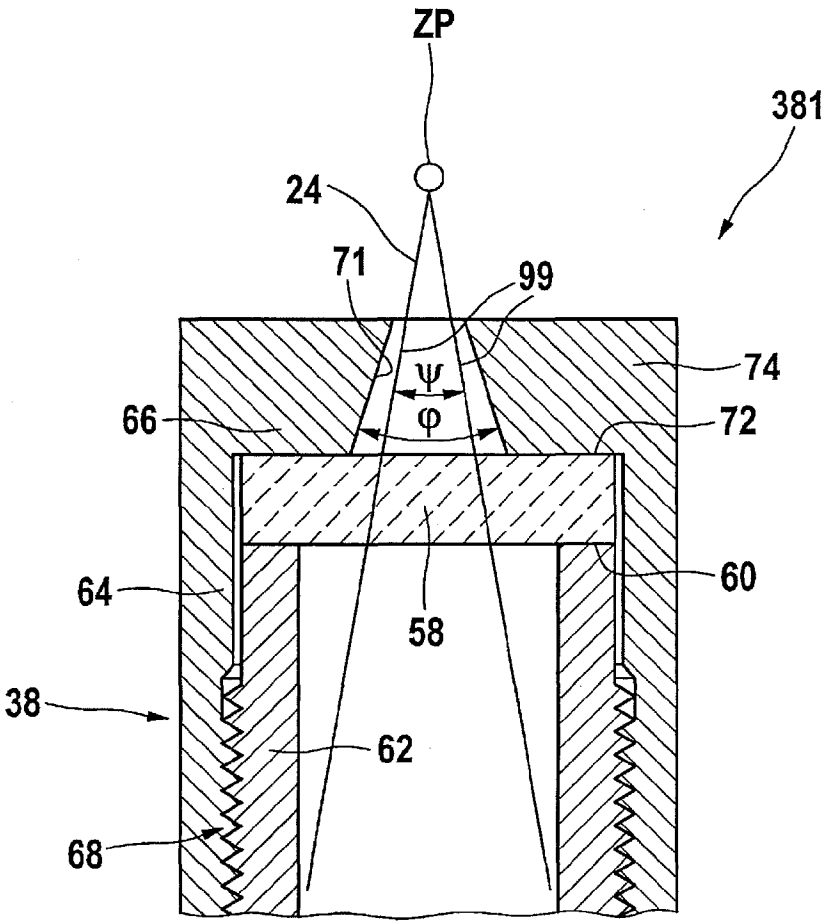
Figure 18:
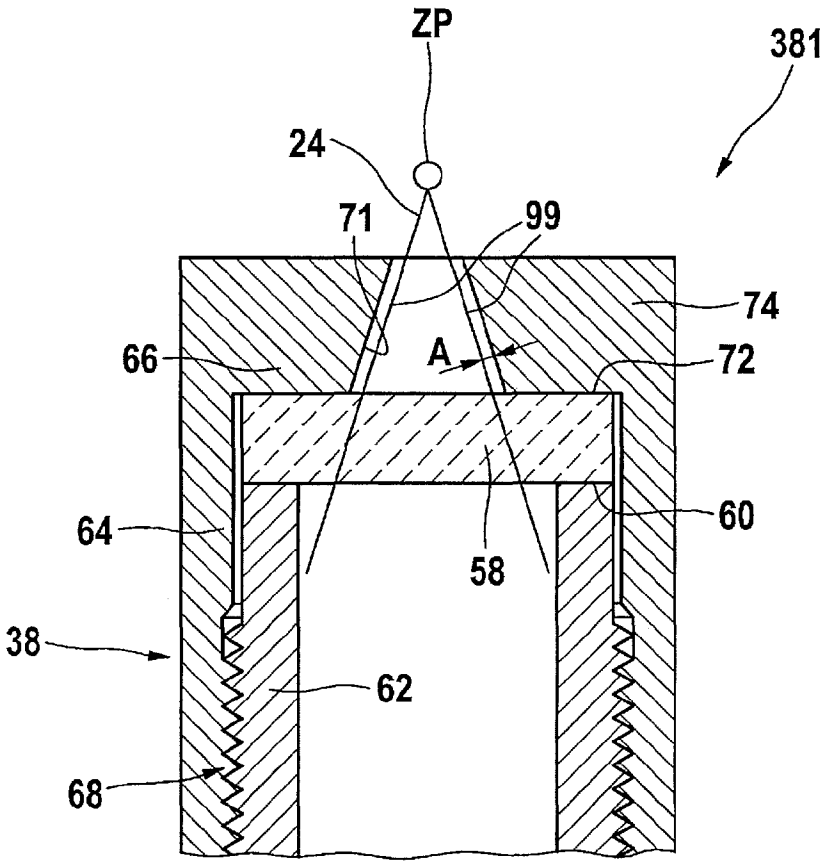

FIGS. 18 and 19 each show a further example of a laser spark plug 100 having a screen 74 and having focusing means 53, in particular a focusing optics 52, for the definition of a beam shape of the laser radiation 24 passing through screen 74 (see FIG. 1B). Laser spark plugs 100 proposed in these examples have the particularity that the shape of screen 74 is selected so as to be advantageous with respect to the shape of the laser radiation 24 passing through it. In these figures, the shape of laser radiation 24 is indicated by cone-shaped envelope lines 99 that intersect approximately at ignition point ZP. In the context of the present invention, the statements relating to the shape of laser radiation 24 are to be understood according to or against the background of the standard DIN EN ISO 11145.

Laser spark plug 100 shown in FIG. 18 has a screen 74 that has, along its entire inner contour 71, a spacing A from laser radiation 24 passing through it of approximately 0.5 mm. Moreover, depicted laser spark plug 100 has the property that 88% of laser radiation 24 transmitted through combustion chamber window 58 passes through screen 58 as laser radiation 24 capable of being focused, while the remaining laser radiation 24 experiences deflection or absorption along inner contour 71 of screen 74 and is not available for focusing.

Laser spark plug 100 shown in FIG. 19 has a screen 74 whose inner contour 71 has the shape of a right circular frustum whose opening angle $\phi$ is 45°. In this example, laser radiation 24 passing through the screen is focused in such a way that beam divergence angle $\psi$ (far field divergence) is 30°.

Figure 20:
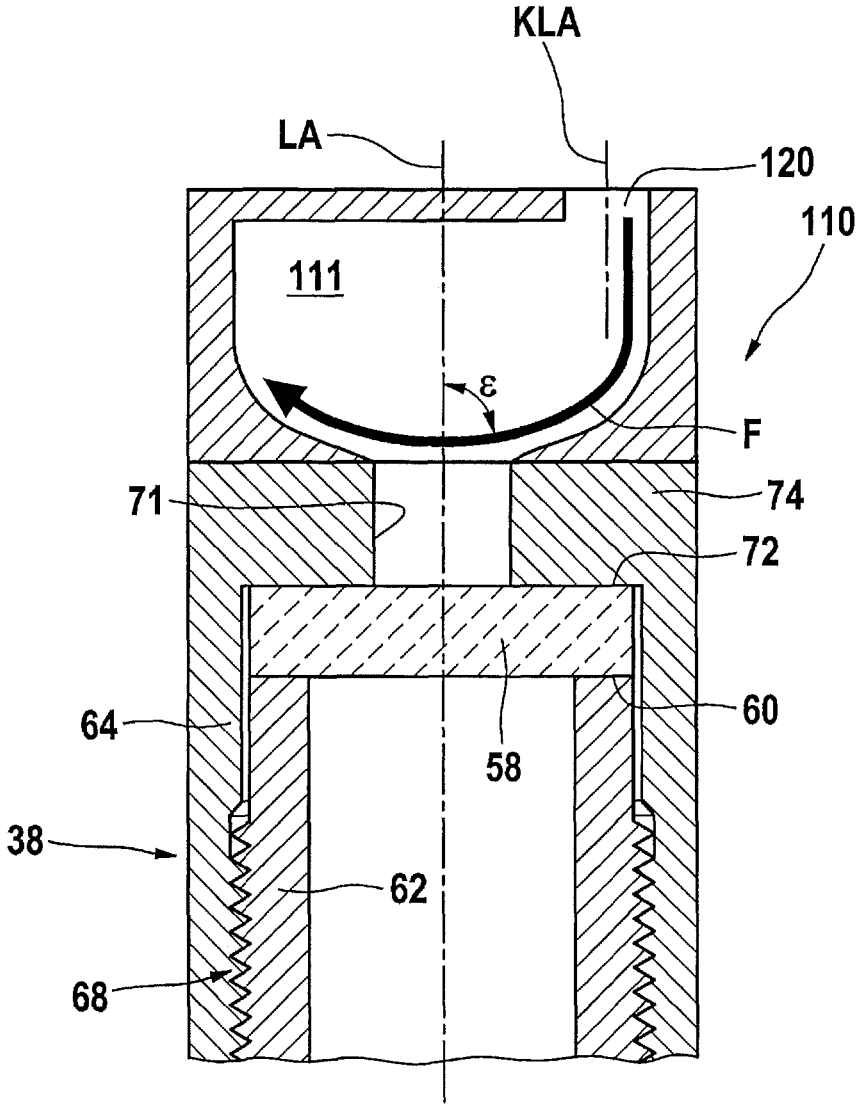
Figure 21B:
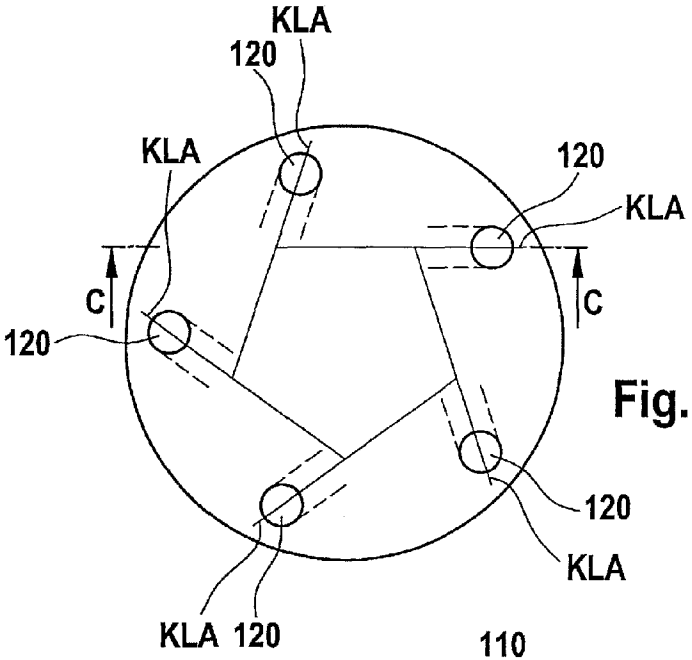
Figure 21C:
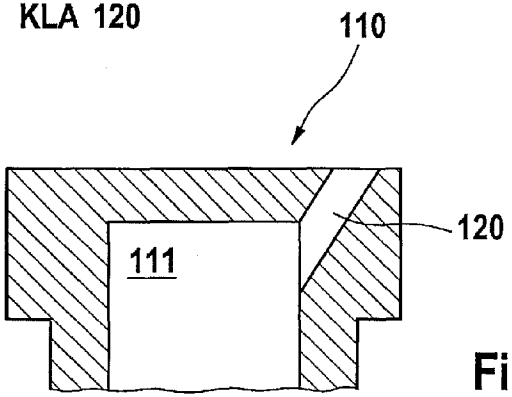
Figure 21A:
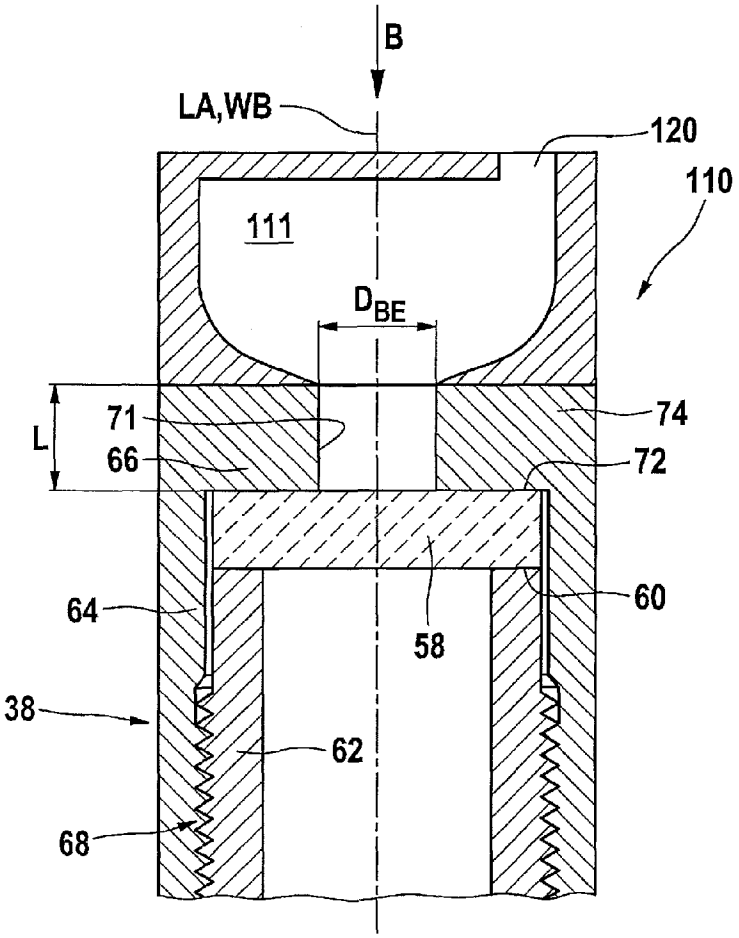

FIGS. 20 and 21 each show an example of a laser spark plug 100 having a screen 74 for the passage of laser radiation 24 into a prechamber 110 situated at the end of housing 38 at the combustion chamber side. A transfer duct 120 is provided for the fluid connection between inner space 111 of prechamber 110 and the combustion chamber.

In the example shown in FIG. 20, longitudinal axis KLA of transfer duct 120 is situated eccentrically and with an offset relative to longitudinal axis LA of laser spark plug 100. In this example, longitudinal axis KLA of transfer bore 120 and longitudinal axis LA of laser spark plug 100 are parallel to one another; alternatively, they can also be situated at an angle to one another in the radial and/or in the tangential direction. When a fluid F flows in, a swirl forms inside prechamber 110 in such a way that the fluid flow along the exit opening of screen 74 runs largely parallel to the exit opening of screen 74. Accordingly, fluid that nonetheless enters into the interior of screen 74 enters into screen 74 at an angle $\epsilon$ that is almost 90°, in particular is always at least 75°, measured relative to longitudinal axis LA of the laser spark plug. In particular, the fluid flow that forms in the interior of screen 74 is a tumble flow. In this example, length L of the screen is 5 mm, and exit diameter $D_{AE}$ of the screen is 6 mm. Thus, in this example the interaction of angle $\epsilon$ at which fluid F enters into the interior of screen 74, length L, and exit diameter $D_{AE}$ of the screen has the result that fluid flow F does not impinge on combustion chamber window 58 immediately, but rather only after deflections on inner contour 71 of screen 74.

Also possible are further embodiments of laser spark plugs 100 having prechambers 110 of which a transfer duct 120 is situated and fashioned such that when a fluid flows through transfer duct 120 into interior space 111 of prechamber 110 there results a fluid flow F that enters into the interior of screen 74 at a minimum angle $\epsilon$, in particular measured relative to the longitudinal axis of the laser spark plug, of 45°, 60°, or 75°; these further embodiments provide in particular that a plurality of transfer ducts 120 are provided. In addition or alternatively, it is also possible to provide additional means (not shown) by which a purge gas can be blown into the prechamber. In particular, it is provided that these means for blowing in purge gas interact together with transfer duct 120 in such a way that overall a fluid flow is fashioned such that when a fluid flows through transfer duct 120 into interior space 111 of prechamber 110 there results a fluid flow F that enters into the interior of screen 74 at a minimum angle $\epsilon$ of 45°, 60°, or 75°, in particular measured relative to the longitudinal axis of the laser spark plug.

FIG. 21 shows a further example of a laser spark plug 100; part a shows a partial longitudinal section along longitudinal axis LA of laser spark plug 100, while part b shows a view in direction B in part a, and part c shows a section along line CC in part b of FIG. 21. For the fluid connection between interior space 111 of prechamber 110 and the combustion chamber, this laser spark plug 100 has five transfer ducts 120 that are disposed symmetrically with an offset from one another of 72° in each case. Longitudinal axes KLA of transfer bores 120 are inclined both in the radial and in the tangential direction in such a way that longitudinal axes KLA of transfer bores 120 form a regular pentagon when viewed in the direction toward the laser spark plug (FIG. 21*b*). Due to the situation and orientation of transfer bores 120, when a fluid F flows into prechamber 110 a swirl forms whose swirl axis WB in the interior of prechamber 110 and in the region of screen 74 coincides with longitudinal axis LA of laser spark plug 100. From the flow conditions in the region of screen 74, it results that in particular heavy particles that leave the flow tangentially in the region of a swirl impinge on inner contour 71 of screen 74 and do not advance to combustion chamber window 58.

The fluid flow forming inside screen 74 is in particular a swirl flow. In this example, length L of the screen is 5 mm, and exit diameter $D_{BE}$ of the screen is 6 mm. Thus, in this example the interaction of angle $\nu$ at which swirl axis WB is tilted relative to longitudinal axis LA of the laser spark plug (here: 0°), length L, and exit diameter $D_{AE}$ of screen 74 has the result that the stated particles do not impinge on combustion chamber window 58 when they depart from the flow in the tangential direction. This effect is also at least partly present for $\tan \nu \leq L/D_{BE}$, in particular for $n^* \tan \nu \leq L/D_{BE}$; n=2, 3, 4.

In addition, it is possible for additional means (not shown) to be provided by which a purge gas can be blown into prechamber 110. In particular, it is provided that these means for blowing in purge gas interact with a transfer duct 120 or a plurality of transfer ducts 120 in such a way that overall a fluid flow is formed such that when a fluid flows through transfer duct 120 or through the transfer ducts into inner space 111 of prechamber 110, there results a fluid flow that has a swirl that rotates about a swirl axis WB, having a component in the direction of longitudinal axis LA of laser spark plug 100, in particular parallel or coaxial to longitudinal axis LA of laser spark plug 100.

Although on the one hand an axially symmetrical shape is preferred for screens 74 shown in FIGS. 2 through 21, as depicted, deviations from axial symmetry may also be advantageously provided.

The present invention is not limited to the embodiments and examples depicted above and/or explicitly explained and/or explicitly shown in the Figures; rather, further embodiments and examples result from combinations of the features explained in relation to the individual embodiments and examples, in a manner that can be carried out by someone skilled in the art. Of these combinations, in particular those are significant whose advantageous effect has already been explicitly emphasized above.

In particular, specific embodiments are advantageous and can be carried out by someone skilled in the art that are based on an interaction of a respective feature or, to the extent that they do not exclude one another, a plurality of the above-disclosed features from two or more than two of the following feature groups: lengths L of screen 74 identified above as advantageous; selections of the material of screen 74 identified above as advantageous; realizations of a gap positioned before combustion chamber window 58 at the combustion chamber side identified above as advantageous; cross-sections of screen 74 identified above as advantageous; relations between lengths L and cross-sections Q of screen 74 identified above as advantageous; features of inner contour 71 of screen 74, in particular edges 83 and extremal cross-sections of screen 74, identified above as advantageous; features identified above as advantageous that relate to an advantageous design of the shape of screen 74 with regard to the shape of laser radiation 24 passing through the screen; features identified above as advantageous relating to the design of an outer edge 88 of screen 74; features identified above as advantageous relating to the design of a prechamber 110, in particular of a transfer duct 120.

What is claimed is:

1. A laser spark plug for an internal combustion engine, comprising:

at least one laser unit for at least one of producing, shaping, and guiding laser radiation;

a combustion chamber window; and a housing having a screen at an end of the housing on the combustion chamber side, the screen being on the opposite side of the combustion chamber window from the laser unit, wherein the screen facilitates passage of the laser radiation from the laser unit into a combustion chamber, wherein the screen contains a passageway, which is limited radially by an inner contour of the screen, and wherein the screen has a first end facing the combustion chamber and a second end facing away from the combustion chamber, the inner contour of the screen having an extremal cross-section in a region situated at a distance both from the first end of the screen facing the combustion chamber and from the second end of the screen facing away from the combustion chamber.

2. The laser spark plug as recited in claim 1, wherein:

the screen has an entry cross-section at the second end facing away from the combustion chamber and an exit cross-section at the first end facing the combustion chamber;

the extremal cross-section is one of (i) at least 10% smaller than the entry cross-section and at least 10% smaller than the exit cross-section, or (ii) at least 10% larger than the entry cross-section and at least 10% larger than the exit cross-section.

3. The laser spark plug as recited in claim 2, wherein the inner contour of the screen has two segments which each have a frustum shape.

4. The laser spark plug as recited in claim 3, wherein the two segments of the inner contour of the screen are immediately adjacent to one another.

5. The laser spark plug as recited in claim 2, wherein the inner contour of the screen has a constriction which includes an edge.

6. The laser spark plug as recited in claim 2, wherein the inner contour of the screen has a bulge which includes an edge.

7. The laser spark plug as recited in claim 2, wherein the length of the screen is at least 4 mm.

8. The laser spark plug as recited in claim 1, wherein:

the screen facilitates passage of the laser radiation from the laser unit into a prechamber which is surrounded by the combustion chamber; and at least one transfer duct provides a fluid connection between an inner space of the prechamber and the combustion chamber surrounding the prechamber, the at least one transfer duct being configured such that when a fluid flow through the transfer duct into the inner space of the prechamber is established, a resulting fluid flow which enters into the interior of the screen at a minimum angle of 45° measured relative to the longitudinal axis of the laser spark plug is provided.

9. The laser spark plug as recited in claim 1, wherein:

the screen facilitates passage of the laser radiation from the laser unit into a prechamber which is surrounded by the combustion chamber; and at least one transfer duct provides a fluid connection between an inner space of the prechamber and the combustion chamber surrounding the prechamber, the at least one transfer duct being configured such that when a fluid flow through the transfer duct into the inner space of the prechamber is established, a resulting fluid flow which in the region of the screen has at least one swirl rotating about a swirl axis and having a component in the direction of the longitudinal axis of the laser spark plug is provided.

* * * * *